US011849834B2

(12) United States Patent
Park

(10) Patent No.: US 11,849,834 B2
(45) Date of Patent: Dec. 26, 2023

(54) CLEANING TOOL

(71) Applicant: Hak Su Park, Incheon (KR)

(72) Inventor: Hak Su Park, Incheon (KR)

( * ) Notice: Subject to any disclaimer, the term of this patent is extended or adjusted under 35 U.S.C. 154(b) by 124 days.

(21) Appl. No.: 17/763,343

(22) PCT Filed: Sep. 23, 2020

(86) PCT No.: PCT/KR2020/012806
§ 371 (c)(1),
(2) Date: Mar. 24, 2022

(87) PCT Pub. No.: WO2021/177523
PCT Pub. Date: Sep. 10, 2021

(65) Prior Publication Data

US 2022/0369800 A1 Nov. 24, 2022

(30) Foreign Application Priority Data

Mar. 2, 2020 (KR) ..... 10-2020-0026028

(51) Int. Cl.
*A46B 11/06* (2006.01)
*A46B 5/00* (2006.01)

(52) U.S. Cl.
CPC ..... *A46B 11/063* (2013.01); *A46B 5/0095* (2013.01); *A46B 11/06* (2013.01)

(58) Field of Classification Search
CPC ..... A46B 11/063; A46B 5/0095; A46B 11/06; A46B 11/0072; A46B 11/066
USPC ..... 4/597, 605, 606; 401/289
See application file for complete search history.

(56) References Cited

U.S. PATENT DOCUMENTS 5,454,659 A * 10/1995 Vosbikian ..... A47L 13/17 401/207
6,983,866 B2 * 1/2006 Smart ..... A47K 7/03 222/481.5
6,997,632 B1 * 2/2006 Adams ..... A46B 11/06 401/289

FOREIGN PATENT DOCUMENTS

| | | | |
|---|---|---|---|
| JP | 3021667 | U | 2/1996 |
| KR | 20-1990-0004668 | Y1 | 5/1990 |
| KR | 10-2001-0046547 | A | 6/2001 |
| KR | 20-0307823 | Y1 | 3/2003 |
| KR | 10-2011-0115213 | A | 10/2011 |
| KR | 20-2016-0003430 | U | 10/2016 |
| KR | 10-1964017 | B1 | 3/2019 |
| KR | 10-2143733 | B1 | 8/2020 |

* cited by examiner

*Primary Examiner* — David J Walczak
(74) *Attorney, Agent, or Firm* — NKL LAW; Jae Youn Kim

(57) ABSTRACT

A cleaning tool is connected to the end of a shower hose after a shower head has been separated from the end of the shower hose, and tap water can be supplied to a surface to be cleaned, such as a bathroom wall or floor, so that bathroom cleaning may be easily carried out even by a user's one hand in a convenient way, thereby minimizing the user's power consumption and shortening cleaning time, and further, the cleaning tool may be conveniently fastened and separated to and from the end of the shower hose by means of a single touch, so that a cleaner for cleaning the surface to be cleaned can be simply exchanged with the shower head, thereby improving the conveniences of use.

10 Claims, 19 Drawing Sheets

CLEANING TOOL

TECHNICAL FIELD

The present invention relates to a cleaning tool, and more specifically, to a cleaning tool that is capable of being connected to the end of a shower hose, after a shower head is separated from the end of the shower hose, to thus supply tap water to a surface to be cleaned, such as a bathroom wall or floor, while cleaning the surface to be cleaned, so that the cleaning tool is usefully used in cleaning.

BACKGROUND ART

Generally, a shower is a device that is installed on a bathroom wall to release cold water, hot water, or mixed water through a control valve of a faucet coupled to cold and hot water supply pipes, and between the faucet and a shower head is connected a flexible hose (hereinafter, referred to as 'shower hose').

Further, the shower hose and the shower head have screw portions formed correspondingly to each other on the coupled portions thereof so that they can be fastened to each other, and after the shower hose is taken by a user, generally, the shower head rotates and is thus fastened to the shower hose.

In this case, the shower head is typically made of a synthetic resin, and if the shower head rotates in a state of being fastened to the shower hose, the screw thread of the shower head may be broken to cause water leakage from the shower head.

So as to solve such a problem, a conventional technology is disclosed in Korean Patent No. 10-1964019. The conventional technology relates to a shower head having a one-touch connection nipple structure, and in specific, a one-touch connection nipple is disposed on a connection portion between the shower head and a shower hose, so that the shower head can be coupled conveniently and rapidly, thereby improving conveniences of coupling and use thereof.

Under the conventional structure, however, it is possible that the shower head is just exchangeably coupled to the end of the shower hose connected to the faucet, and accordingly, only the shower head is connected to the shower hose, thereby causing the shower to be extremely limited in the use purposes thereof.

For example, because a bathroom may be covered with scales due to high moisture, it should be frequently cleaned, and in this case, after a surface to be cleaned is cleaned by means of a cleaning brush, tap water is sprayed onto the surface to be cleaned to remove scales or other dirties. Otherwise, the surface is cleaned by means of the cleaning brush taken by the user's one hand, while the shower head is being held by the user's other hand and is supplying water to the surface to remove scales or other dirties. Accordingly, bathroom cleaning is inconveniently carried out, high power consumption is needed, and cleaning time is extended longer.

DISCLOSURE

Technical Subject

Accordingly, the present invention has been made to solve the above-mentioned problems, and it is an object of the present invention to provide a cleaning tool that is capable of being connected to the end of a shower hose, after a shower head is separated from the end of the shower hose, to thus supply tap water to a surface to be cleaned, such as a bathroom wall or floor, so that bathroom cleaning may be carried out even by a user's one hand in a convenient way.

It is another object of the present invention to provide a cleaning tool that is capable of being conveniently fastened and separated to and from the end of a shower hose by means of a single touch, so that a cleaner for cleaning a surface to be cleaned can be simply exchanged with a shower head, thereby improving the conveniences of use.

Technical Solution

To accomplish the above-mentioned objects, according to the present invention, there is provided a cleaning tool including: a handle having a first connection means disposed on one end of a shower hose, a second connection means detachably coupled to the first connection means, and a main flow path along which tap water flows from one end thereto to the other end thereof; and a cleaner detachably coupled to the other end of the handle to clean a surface to be cleaned with the tap water supplied from the handle.

In this case, the handle may include a finishing member disposed on the other end thereof and having a water discharge hole formed thereon and a cleaner support disposed on the finishing member to allow the cleaner to be detachably mounted thereon.

Further, the cleaner support may have a front support protrusion protruding forward from the front end of the finishing member disposed on the other end of the handle and a rear support protrusion protruding backward from the rear end of the finishing member, and the cleaner may include a support body detachably supported against the cleaner support; and a cleaning member disposed on the underside of the support body, the support body including a water guide hole formed thereon to guide the tap water moving through the water discharge hole of the finishing member disposed on the other end of the handle to the cleaning member, a front support groove formed on the front end of top surface thereof to supportedly fit the front support protrusion of the cleaner support thereto, and a rear support groove formed on the rear end of top surface thereof to supportedly fit the rear support protrusion of the cleaner support thereto.

In this case, the cleaner may further have a locking projection with a guide inclination surface protruding from top of the rear support groove to support the rear support protrusion of the cleaner support and a releasing piece extending backward from the locking projection.

Further, the cleaner support may include a first cylindrical fastening protrusion protruding downward from the underside of the finishing member around a water discharge hole formed on the finishing member, and the first fastening protrusion having an insertion groove open downward and a first support projection and a stop projection formed on the inner peripheral surface of the insertion groove, and the cleaner may include a second cylindrical fastening protrusion protruding upward from the top of the support body thereof around a water guide hole formed on the support body and fitted to the insertion groove of the first fastening protrusion and a second support projection formed on the outer peripheral surface of the second fastening protrusion to support the first support projection of the first fastening protrusion thereagainst.

Further, the cleaning member is formed of bristles whose tops are implanted on the underside of the support body or formed of a sponge and towel disposed on the underside of the support body.

The cleaner may include a cover disposed on top of the support body to form a buffering space therein, a water guide hole formed on the cover, and a plurality of water discharge holes formed on the bottom of the buffering space.

Further, the first connection means may include a fixing member having a first path formed in a longitudinal direction thereof, one end portion fixed to the front end of the shower hose, and a plurality of ball seating portions formed on the other end portion thereof, a plurality of fixing balls rotatably disposed on the plurality of ball seating portions, and a push member fastened to the outer peripheral surface of the fixing member to support the fixing balls and movable along the fixing member to allow the fixing balls to appear and disappear toward and from the first path, the fixing member including a support projection formed on the outer peripheral surface of the other end portion thereof, and the push member including a spring seating groove formed on the inside thereof to mount a first spring thereonto so that the push member can be pressurized toward the other end portion of the fixing member and a control protrusion disposed on the outside thereof to be taken by the user's hand, and the second connection means may include: a connection part disposed on one end portion thereof, having a second path formed in a longitudinal direction thereof, and fitted to the first path of the fixing member; and a connection member disposed on the other end portion thereof and having a female screw thread screw-coupled to the handle, the connection part including ball support grooves formed on the outer peripheral surface thereof to support the fixing balls thereagainst on the same circumferences as the fixing balls.

The first connection means may include a coupling member fixed to the front end of the shower hose, having a through hole formed on the center thereof, a seating portion formed open on the other end thereof, and a male screw thread formed on the outer peripheral surface thereof, a support ring supported against the other end of the coupling member and having an opening and closing through hole formed on the center thereof, an opening and closing member elastically supported against the seating portion of the coupling member by means of a second spring to open and close the opening and closing through hole, a fixing member having a first path formed in a longitudinal direction thereof, a female screw thread formed on one end portion thereof and screw-coupled to the coupling member, a pressurizing protrusion protruding from the center of the first path to pressurize the support ring toward the other end portion of the coupling member, and a plurality of ball seating portions formed on the other end portion thereof, a plurality of fixing balls rotatably disposed on the plurality of ball seating portions, and a push member fastened to the outer peripheral surface of the fixing member to support the fixing balls and movable along the fixing member to allow the fixing balls to appear and disappear toward and from the first path, the fixing member including a support projection formed on the outer peripheral surface of the other end portion thereof, and the push member including a spring seating groove formed on the inside thereof to mount a first spring thereon so that the push member is pressurized against the other end portion of the fixing member, and the second connection means may include a connection part disposed on one end portion thereof, having a second path formed in a longitudinal direction thereof, and fitted to the first path of the fixing member; and a connection member disposed on the other end portion thereof and having a female screw thread screw-coupled to the handle, the connection part including ball support grooves formed on the outer peripheral surface thereof to support the fixing balls thereagainst on the same circumferences as the fixing balls so that when the connection part is inserted into the first path of the fixing member, the end portion of the connection part pressurizes the opening and closing member to open the opening and closing through hole of the support ring.

Further, the first connection means may include a coupling member fixed to the front end of the shower hose, having a through hole formed on the center thereof, a seating portion formed open on the other end thereof, and a male screw thread formed on the outer peripheral surface thereof, a fixing member having a first path formed in a longitudinal direction thereof, a female screw thread formed on one end portion thereof and screw-coupled to the coupling member, and a plurality of ball seating portions formed on the other end portion thereof, a plurality of fixing balls rotatably disposed on the plurality of ball seating portions, and a push member fastened to the outer peripheral surface of the fixing member to support the fixing balls and movable along the fixing member to allow the fixing balls to appear and disappear toward and from the first path, the fixing member including a support projection formed on the outer peripheral surface of the other end portion thereof, and the push member including a spring seating groove formed on the inside thereof to mount a first spring thereon so that the push member is pressurized against the other end portion of the fixing member, and the second connection means may include a connection part disposed on one end portion thereof, having a second path formed in a longitudinal direction thereof, and fitted to the first path of the fixing member; and a connection member disposed on the other end portion thereof and having a female screw thread screw-coupled to the handle, the connection part including ball support grooves formed on the outer peripheral surface thereof to support the fixing balls thereagainst on the same circumferences as the fixing balls.

Moreover, the handle may include a tap water controller adapted to open and close the main flow path along which the tap water moves, and the tap water controller includes a slide member fitted to guide members disposed up and down on the handle to be movable up and down and having a guide hole formed in a forward and backward direction thereof, button members coupled to upper and lower ends of the slide member and pressurized by the user's hand, and a pressurizing member fitted to a seating portion formed on the main flow path and having a flow path formed in a forward and backward direction thereof to move the tap water therealong so that the other end thereof comes into close contact with one end of the slide member by means of the elasticity of a spring disposed in the flow path.

Advantageous Effects

According to the present invention, if the cleaning tool is connected to the end of the shower hose after the shower head is separated from the end of the shower hose, the tap water can be supplied to the surface to be cleaned, such as a bathroom wall or floor, so that bathroom cleaning may be carried out even by the user's one hand in a convenient way, thereby minimizing the user's power consumption and shortening cleaning time.

Moreover, the cleaning tool according to the present invention may be conveniently fastened and separated to and from the end of the shower hose by means of a single touch, so that the cleaner for cleaning the surface to be cleaned can be simply exchanged with the shower head, thereby improving the conveniences of use.

BEST MODE FOR INVENTION

Figure 1:
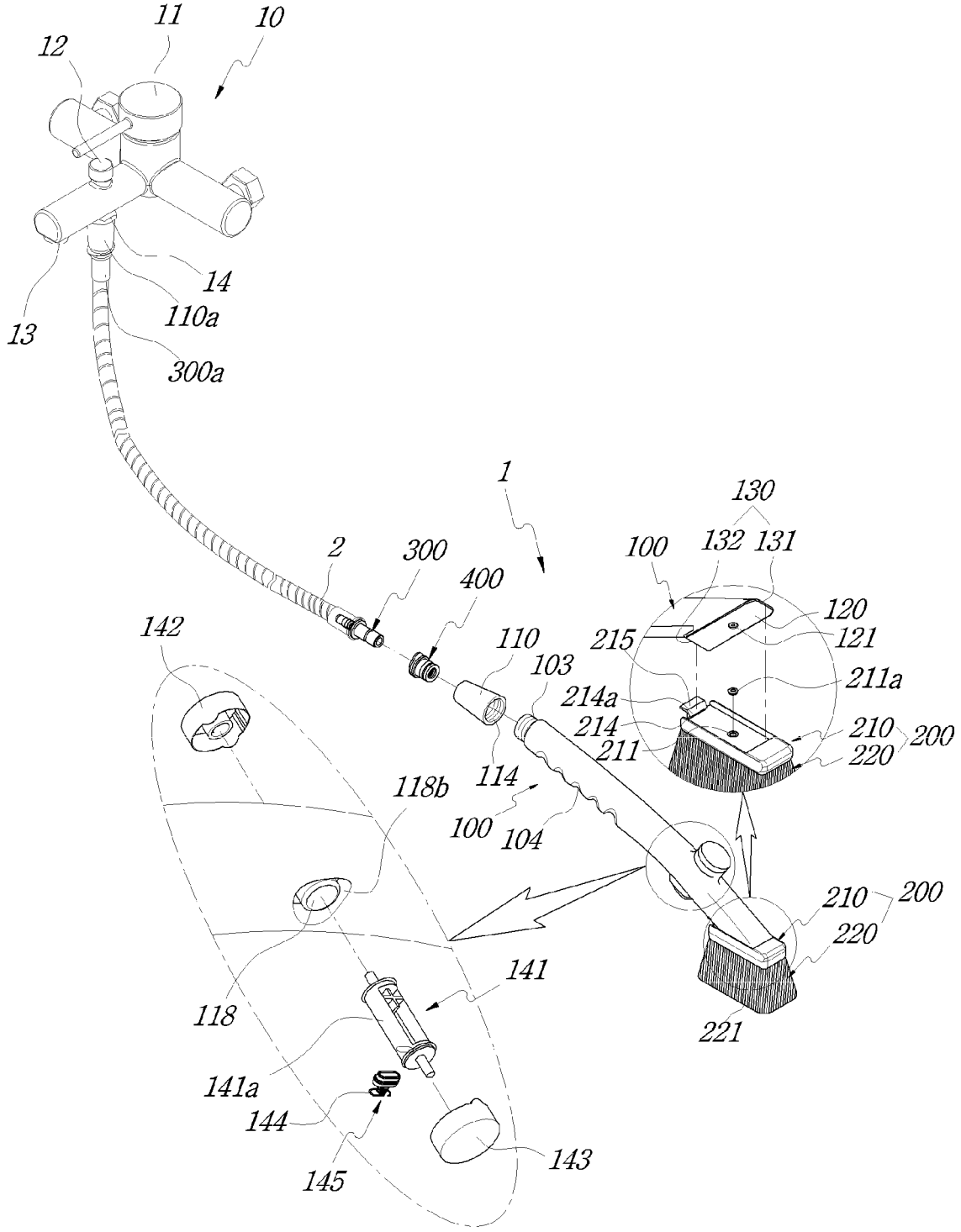
FIG. 1 is an exploded perspective view showing a cleaning tool according to a first embodiment of the present invention.
Figure 2:
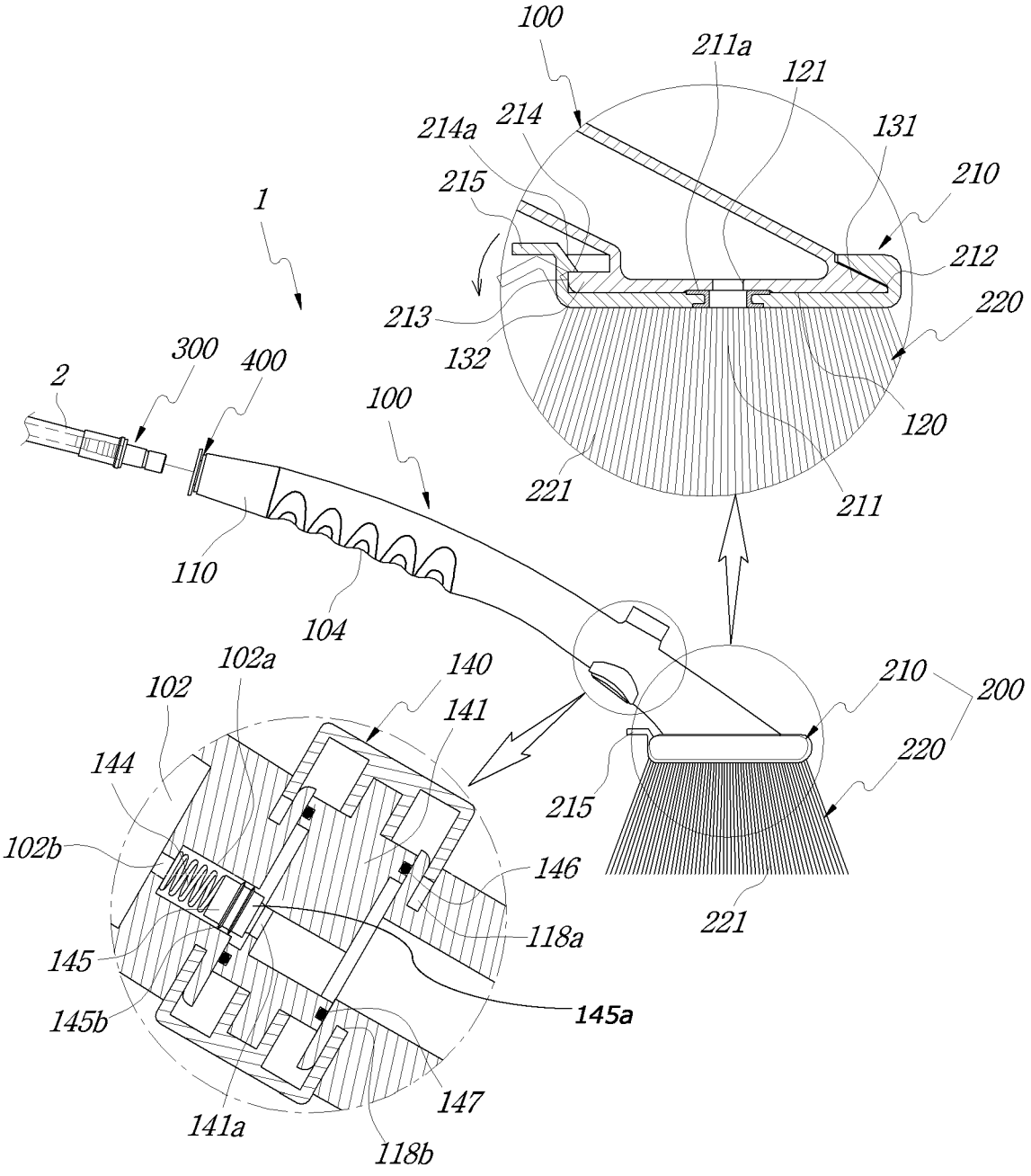
FIG. 2 is a sectional view showing a state before the cleaning tool according to the first embodiment of the present invention is connected to an end of a shower hose.
Figure 3:
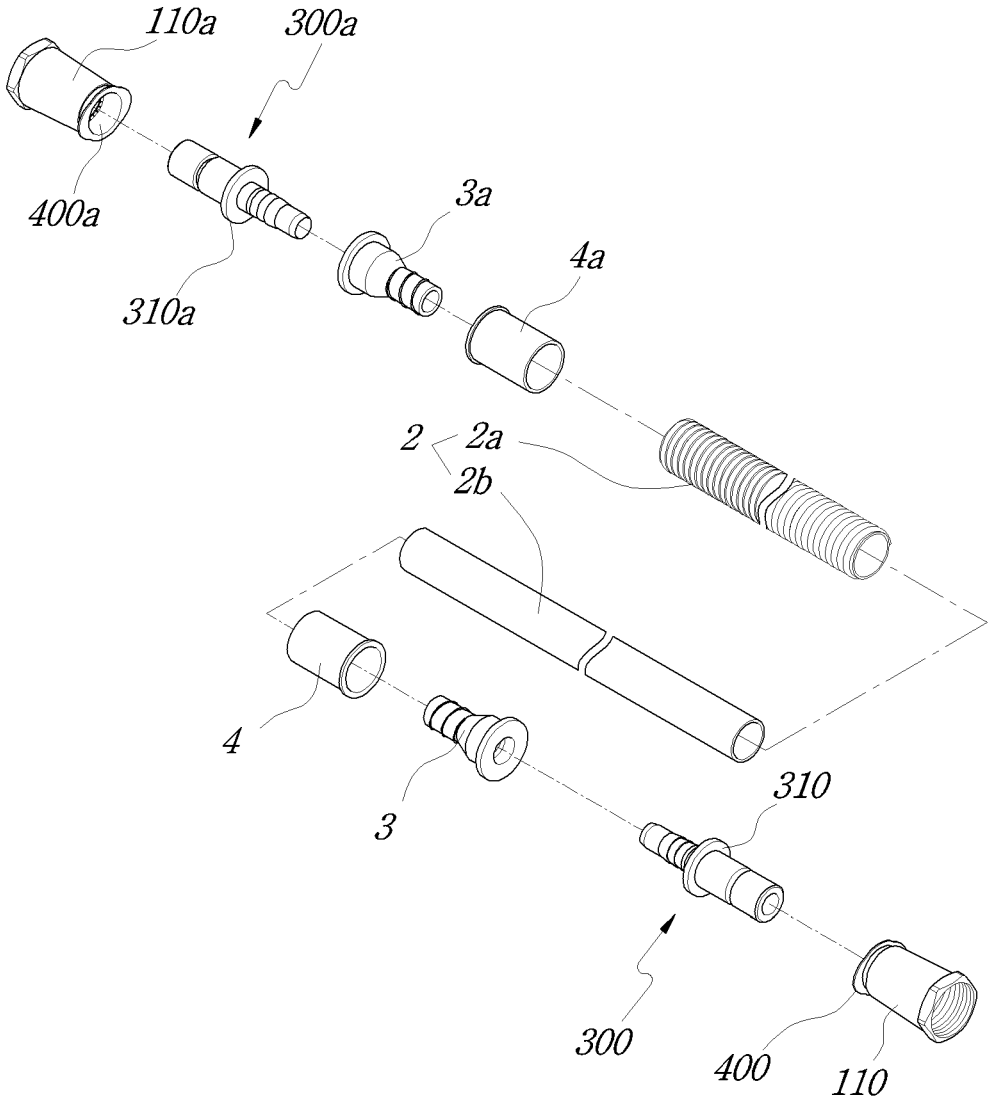
FIG. 3 is an exploded perspective view showing connection structures of both ends of the shower hose adopted according to the first embodiment of the present invention.
Figure 4:
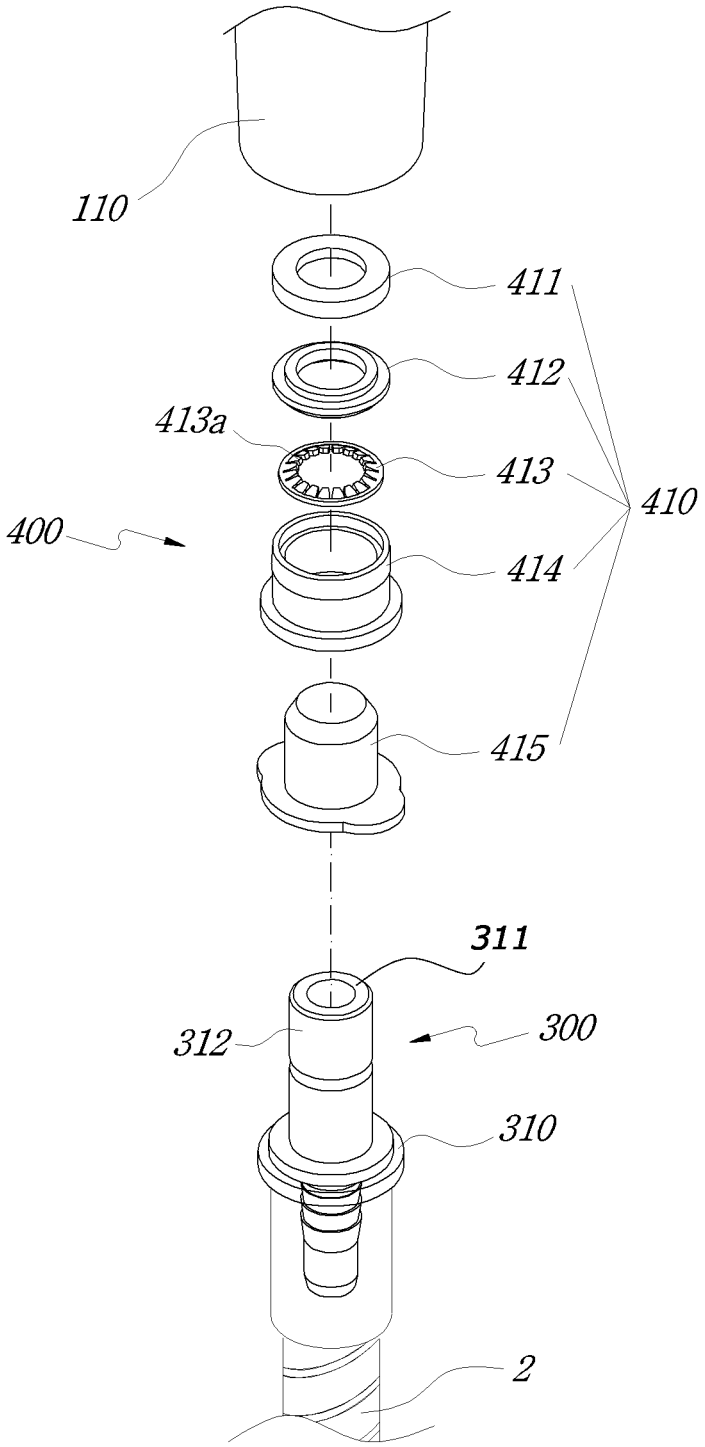
FIG. 4 is an exploded perspective view showing connection means of the cleaning tool according to the first embodiment of the present invention.
Figure 5:
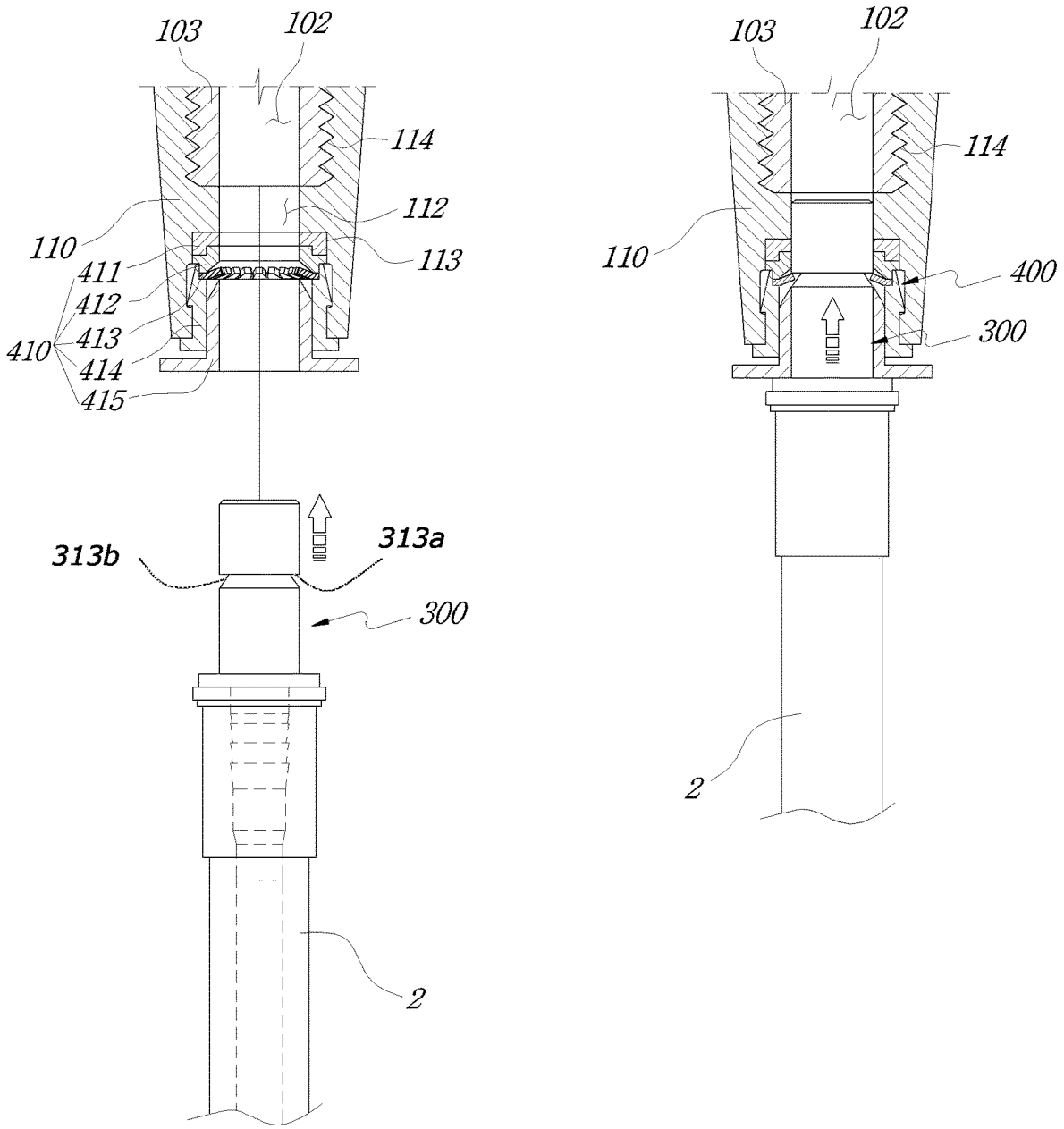
FIG. 5 is a sectional view showing states before and after the cleaning tool according to the first embodiment of the present invention is connected to the end of the shower hose.
Figure 6:
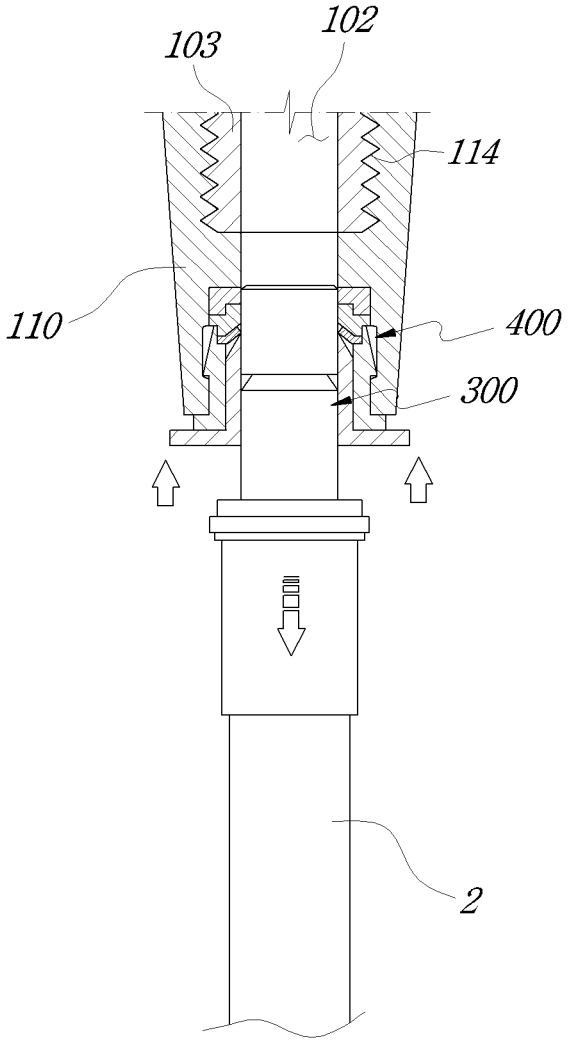
FIG. 6 is a sectional view showing a state where the cleaning tool according to the first embodiment of the present invention is separated from the end of the shower hose.

Hereinafter, a cleaning tool according to the present invention will now be described in detail with reference to the attached drawings.

The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

FIGS. 1 to 6 show a cleaning tool according to a first embodiment of the present invention. The cleaning tool 1 according to the first embodiment of the present invention is connected to an end of a shower hose 2 connected to a faucet 10 after a shower head (not shown) has been separated from the end of the shower hose 2.

In this case, the faucet 10 has a known configuration in which cold water, hot water, or mixed water is released toward a front outlet or a shower water outlet through the control of a control lever and a switching lever for cold and hot water supplied from cold and hot water pipes, and an example of the faucet 10 is disclosed in Korean Patent No. 10-1964019.

According to the present invention, the shower hose 2 includes a hose cover 2*a*, a hose tube 2*b* disposed inside the hose cover 2*a*, hose connection members 3 and 3*a* disposed on both ends thereof and fixedly fitted to the hose tube 2*b*, and hose finishing members 4 and 4*a* for finishing the outer appearance thereof. In this case, the cleaning tool 1 of the present invention and the faucet 10 are connected to both ends of the shower hose 2.

In this case, the faucet 10 is configured to allow the cold water, hot water, or mixed water to be discharged toward a front outlet 13 or a shower water outlet 14 through the control of a control lever 11 and a switching lever 12 for cold and hot water supplied from cold and hot water pipes, and accordingly, the shower hose 2 is connected to the shower water outlet 14 of the faucet 10.

Hereinafter, the present invention will be explained in detail.

First, the cleaning tool 1 includes a handle 100 having a main flow path 102 along which tap water flows from one end thereof to the other end thereof and a fastener 110 coupled to one end thereof and a cleaner 200 coupled to the other end of the handle 100 to clean a surface to be cleaned.

In this case, a male screw thread 103 is formed on one end of the handle 100, and a through path 112 is formed longitudinally on the fastener 110 to move the tap water therealong. A female screw thread 114 is formed along the inner peripheral surface of the through path 112, and accordingly, the fastener 110 is screw-coupled to one end of the handle 100.

Further, the handle 100 has a slip prevention portion 104 with various shapes such as grooves, protrusions, and the like formed on the outer surface thereof so as to prevent slipping from a user's hand and a tap water controller 140 disposed on a front side thereof to open and close the main flow path 102 along which the tap water moves.

The tap water controller 140 includes a slide member 141 fitted to guide members 118 disposed up and down on the handle 100 to be movable up and down and having a guide hole 141*a* formed in a forward and backward direction thereof, button members 142 and 143 coupled to upper and lower ends of the slide member 141 and pressurized by the user's hand, and a pressurizing member 145 fitted to a seating portion 102*a* formed on the main flow path 102 of the handle 100 and having a flow path 145*a* formed in a forward and backward direction thereof to move the tap water therealong so that the other end thereof comes into close contact with one end of the slide member 141 by means of the elasticity of a spring 144 disposed in the flow path 145*a*.

To prevent the tap water from leaking to the outside when the slide member 141 moves in upward and downward directions in a state of being fitted to the guide members 118 of the handle 100, in this case, the slide member 141 has first and second O-rings 146 and 147 mounted on top and bottom outer peripheries thereof.

Further, the button members 142 and 143, which are coupled to both ends of the slide member 141, serve to prevent the slide member 141 from escaping from the guide members 118 of the handle 100 and have outer diameters bigger than inner diameters of the guide members 118 of the handle 100 so as to allow the slide member 141 to move forward and backward in a limited range. To prevent the user's skin from being caught to the ends of the button members 142 and 143, in specific, the guide members 118 have support grooves 118*a* and 118*b* formed on both ends thereof to allow the button members 142 and 143 to move in a limited range.

Additionally, the seating portion 102*a* is formed on one side of the guide members 118. The seating portion 102*a* has a through hole 102*b* formed on one side of the center thereof in a forward and backward direction thereof, and accordingly, the tap water moves from the main flow path 102 to the through hole 102*b*. In this case, the pressurizing member 145 made of a rubber material is fitted to the seating portion 102*a*, and in this case, the pressurizing member 145 includes a flow path 145*a* formed in a forward and backward direction thereof to move the tap water therealong and a contacting protrusion 145*b* formed on the outer peripheral surface thereof to come into close contact with the wall surface of the seating portion 102*a* so that the tap water moves from one end of the flow path 145*a* to the other end thereof.

Further, the other end of the coil-shaped spring 144 is insertedly supported into the pressurizing member 145, and one end of the spring 144 is supported against the seating portion 102*a*, so that the other end of the pressurizing member 145 is brought into close contact with one side of the middle portion of the slide member 141 by means of the elasticity of the spring 144.

Under the above-mentioned configuration, the slide member 141 moves by means of the user's control for the button members 142 and 143, and accordingly, if the guide hole 141*a* of the slide member 141 alignedly communicates with the flow path 145*a* of the pressurizing member 145, the tap water moves in the other side direction. Next, if the slide member 141 moves by means of the user's control for the button members 142 and 143 to allow the guide hole 141*a* of the slide member 141 to be misaligned with the flow path 145*a* of the pressurizing member 145, the movement of the tap water stops. That is, the discharge of the tap water can be simply controlled, without any separate control for the tap lever.

Further, the shower hose 2 has a known configuration in which the hose tube is disposed inside the hose cover.

Moreover, the handle 100 includes a finishing member 120 disposed on the other end thereof and having a water discharge hole 121 formed thereon and a cleaner support 130 disposed on the finishing member 120 to allow the cleaner 200 to be detachably mounted thereon.

In this case, the cleaner support 130 includes a front support protrusion 131 protruding forward from the front end of the finishing member 120 disposed on the other end of the handle 100 and a rear support protrusion 132 protruding backward from the rear end of the finishing member 120. In specific, the front support protrusion 131 has an inclination surface slant downward toward the front side thereof.

The cleaner 200 includes a support body 210 detachably supported against the cleaner support 130 and a cleaning member 220 disposed on the underside of the support body 210 to remove scales from the surface to be cleaned such as a bathroom wall or floor.

In this case, the support body 210 of the cleaner 200 has a water guide hole 211 formed thereon to guide the tap water moving through the water discharge hole 121 of the finishing member 120 disposed on the other end of the handle 100 to the cleaning member 220. A water leakage prevention ring 211*a* made of silicon, rubber, or the like is fitted to the water guide hole 211, and if the finishing member 120 comes into close contact with the top of the support body 210 of the cleaner 200, accordingly, the tap water discharged through the water discharge hole 121 is guided to the cleaning member 220 through the water guide hole 211, without any leakage.

Further, the support body 210 of the cleaner 200 has a front support groove 212 formed on the front end of top surface thereof to supportedly fit the front support protrusion 131 of the cleaner support 130 thereto and a rear support groove 213 formed on the rear end of top surface thereof to supportedly fit the rear support protrusion 132 of the cleaner support 130 thereto.

In this case, the front support groove 212 has an inclination surface slant downward toward the front side thereof to gently guide the inclination surface of the front support protrusion 131 so that the inclination surface thereof corresponds to the inclination surface of the front support protrusion 131. Further, the support body 210 has a locking projection 214 with a guide inclination surface 214*a* protruding from top of the rear support groove 213 to support the rear support protrusion 132 of the cleaner support 130 and a releasing piece 215 extending backward from the locking projection 214.

The support body 210 is made of a synthetic resin by means of injection molding, and if the releasing piece 215 is pressurized downward, the locking projection 214 is inclined backward, and if the physical force applied to the releasing piece 215 is released, the locking projection 214 is returned to its original position.

Moreover, the cleaning member 220 disposed on the underside of the support body 210 is formed of bristles 221 whose tops are implanted on the underside of the support body 210.

Under the above-mentioned configuration, the front support protrusion 131 of the cleaner support 130 is supported against the front support groove 212 formed on the front end of top surface of the support body 210 of the cleaner 200, and if the rear support protrusion 132 is pressed, the underside of the rear support protrusion 132 moves down along the guide inclination surface 214*a* of the locking projection 214. Next, the rear support protrusion 132 is seated onto the rear support groove 213, and simultaneously, top of the rear support protrusion 132 is supported against the locking projection 214, so that the cleaner 200 is used to clean the surface to be cleaned, while being supported well against the cleaner support 130, without any escape.

Of course, if the releasing piece 215 is pressurized downward, the locking projection 214 is inclined backward, and top end of the rear support protrusion 132 escapes from the locking projection 214 to allow the cleaner 200 to be separated from the handle 100. If the physical force applied to the releasing piece 215 is released, the locking projection 214 is returned to its original position.

Further, a first connection means 300 is disposed on the end of the shower hose 2, and a second connection means 400 detachable from the first connection means 300 is disposed on one end of the handle 100 of the cleaning tool 1.

In this case, the first connection means 300 is mounted on the front end of the shower hose 2 and has a male coupler 310 with an insertion pipe 311 protruding from the front end thereof, and the second connection means 400 has a female coupler 410 mounted on the fastener 110 coupled to the rear end of the handle 100 of the cleaning tool 1 to lock the insertion pipe 311 or release the locked state thereof. Accordingly, the male coupler 310 connected to the shower hose 2 is coupled to the female coupler 410 connected to the cleaning tool 1 by means of a single touch to connect or separate internal flow paths of the shower hose 2 and the cleaning tool 1.

In this case, the male coupler 310 is cylindrical and has one end fastened to the shower hose 2 and the insertion tube 312 extending from the other end thereof and fitted to the female coupler 410. Further, the insertion tube 312 has an elastic piece locking projection 313*a* having a vertical surface formed on the outer peripheral surface thereof and an elastic piece seating surface 313*b* continuously formed inclined with respect to the elastic piece locking projection 313*a*.

Further, the female coupler 410 includes a first sealing member 411 whose one surface is fittedly seated onto an accommodation space 113 extending from the through path 112 of the fastener 110 screw-coupled to one end of the handle 100, a second sealing member 412, a holder ring 413 having elastic pieces 413*a*, a cap ring 414 for fixing the holder ring 413, and a push ring 415 for operating the holder ring 413, which are insertedly mounted onto the fastener 110 sequentially. Of course, the female coupler 410 may be changed in configuration so that it may be screw-coupled directly to one end of the handle 100, and accordingly, such a change in design may be included in the scope of the present invention.

The male coupler 310 and the female coupler 410 have been explained in detail in Korean Patent No. 10-1964019 filed by the same applicant as the invention. Accordingly, a detailed description on their configuration and operation will be avoided.

Through the configurations of the male coupler 310 and the female coupler 410, the cleaning tool 1 is fastened and separated to and from the end of the shower hose 2 by means of a single touch, so that a shower head and the cleaning tool 1 can be exchanged with each other according to a user's need.

In the drawings, the first connection means 300 is disposed on the end of the shower hose 2 and the second connection means 400 is disposed on the cleaning tool 1, but of course, the second connection means 400 may be disposed on the end of the shower hose 2, and the first connection means 300 may be disposed on the cleaning tool 1. Accordingly, such a simple change in position may be included in the scope of the present invention.

The first connection means 300 and the second connection means 400 are disposed on the cleaning tool 1 and one end of the shower hose 2 by means of a single touch, respectively, but they may not be limited thereto. That is, the hose connection members 3 and 3*a* fittedly fixed to the hose tube 2*b* and the hose finishing members 4 and 4*a* for finishing the outer appearance of the shower hose 2 are provided on both ends of the shower hose 2, respectively, and accordingly, the cleaning tool 1 of the present invention and the faucet 10 are connected to both ends of the shower hose 2. In this case, male couplers 310 and 310*a* of first connection means 300 and 300*a* are press-fitted to the inner peripheries of the hose connection members 3 and 3*a*. Accordingly, the first connection means 300 and 300*a* are fastened or separated to or from a second connection means 400 disposed on the fastener 110 coupled to the cleaning tool 1 and a second connection means 400*a* disposed on a fastener 110*a* coupled to the shower water outlet 14 of the faucet 10 by means of a single touch, so that according to the user's need, only the shower head and the cleaning tool 1 are exchanged on the shower hose 2, and otherwise, the shower hose 2 is separated from the faucet 10.

Figure 7:
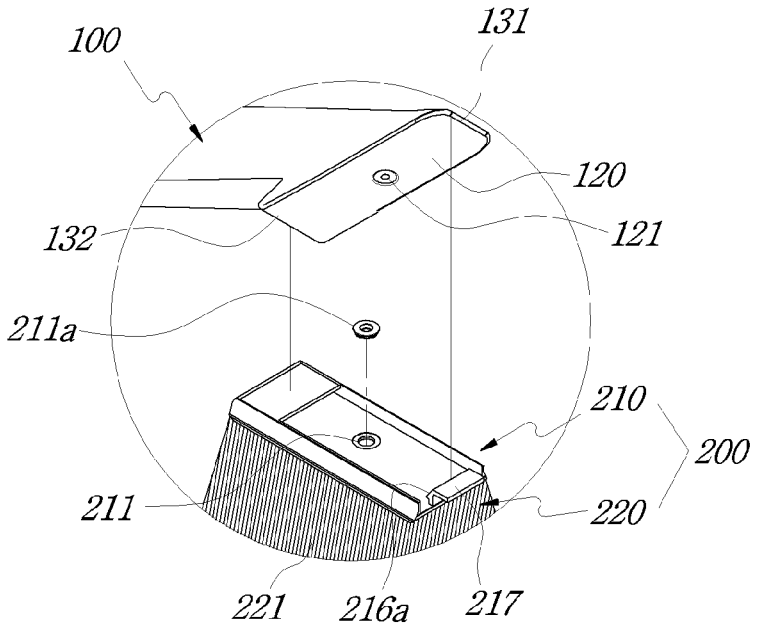
FIG. 7 is a sectional view showing a cleaning tool according to a second embodiment of the present invention.
Figure 7:
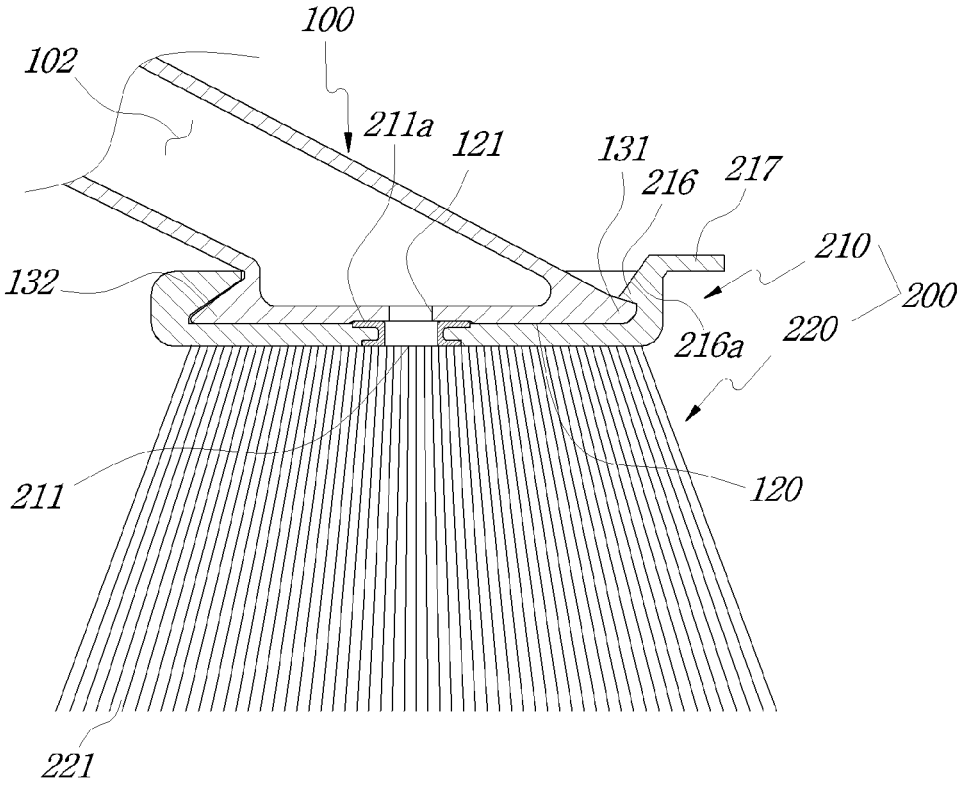

FIG. 7 is a sectional view showing a cleaning tool according to a second embodiment of the present invention. According to the second embodiment of the present invention, a cleaner support 130 disposed on the other end of a handle 100 includes a front support protrusion 131 protruding forward from the front end of a finishing member 120 disposed on the other end of the handle 100 and a rear support protrusion 132 protruding backward from the rear end of the finishing member 120. In specific, the front support protrusion 131 and the rear support protrusion 132 have inclination surfaces slant downward toward the front and rear sides thereof.

In the second embodiment of the present invention, a cleaner 200 includes a support body 210 detachably supported against the cleaner support 130, a front support groove 212 formed on the front end of top surface of the support body 210 to supportedly fit the front support protrusion 131 of the cleaner support 130 thereto, and a rear support groove 213 formed on the rear end of top surface of the support body 210 to supportedly fit the rear support protrusion 132 of the cleaner support 130 thereto.

In this case, the support body 210 has a locking projection 216 with a guide inclination surface 216*a* protruding from top of the front support groove 212 to support the front support protrusion 131 of the cleaner support 130 and a releasing piece 217 extending forward from the locking projection 216.

That is, the locking projection 216 and the releasing piece 217 are provided on top of the front support groove 212 of the cleaner 200, which are opposite in position to the locking projection 214 and the releasing piece 215 in the first embodiment of the present invention, and accordingly, such a change in design may be included in the scope of the present invention. If the releasing piece 217 is pressurized downward, the locking projection 216 is inclined forward to allow the cleaner 200 to be separated from the handle 100, and if the physical force applied to the releasing piece 217 is released, the locking projection 216 is returned to its original position.

Figure 8:
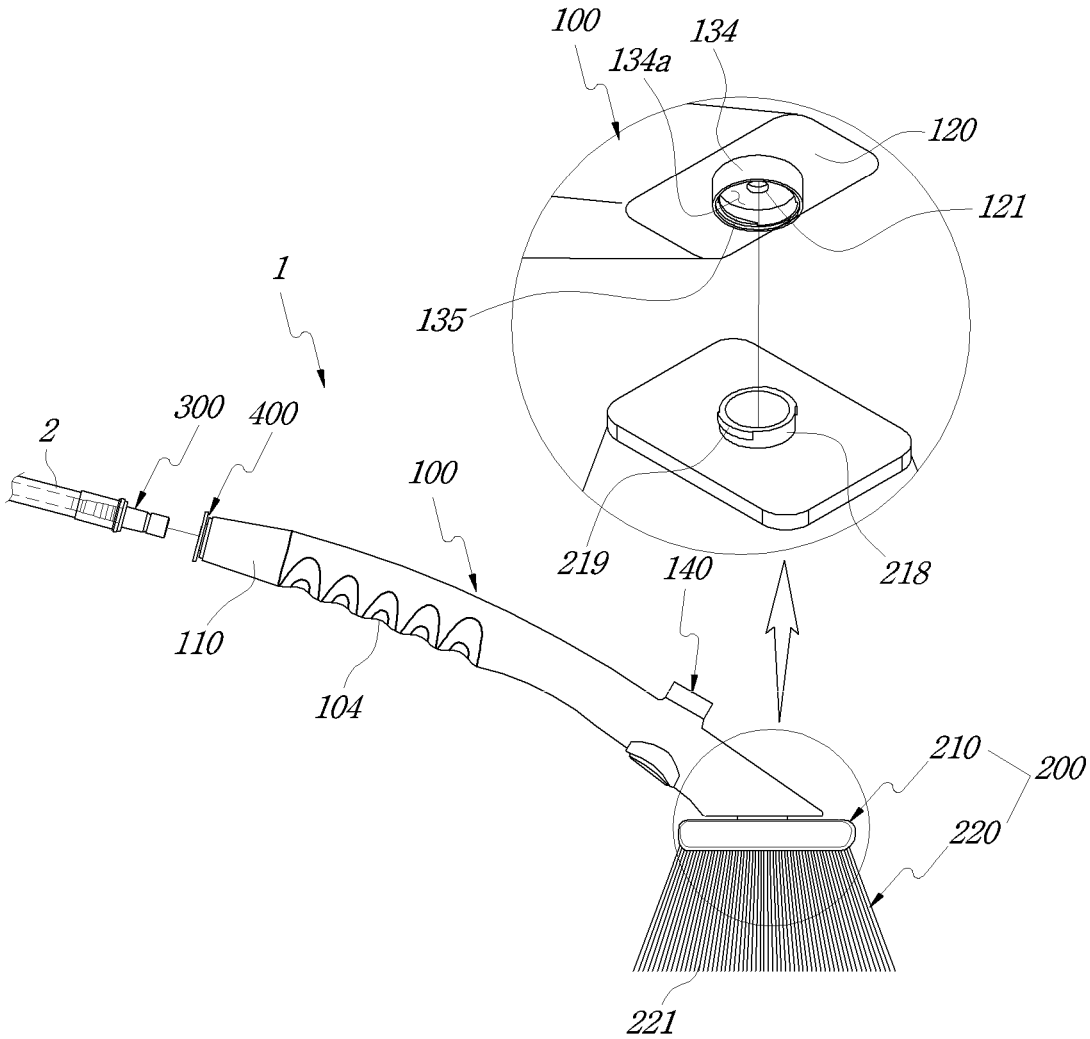
FIG. 8 is an exploded perspective view showing a cleaning tool according to a third embodiment of the present invention.
Figure 9:
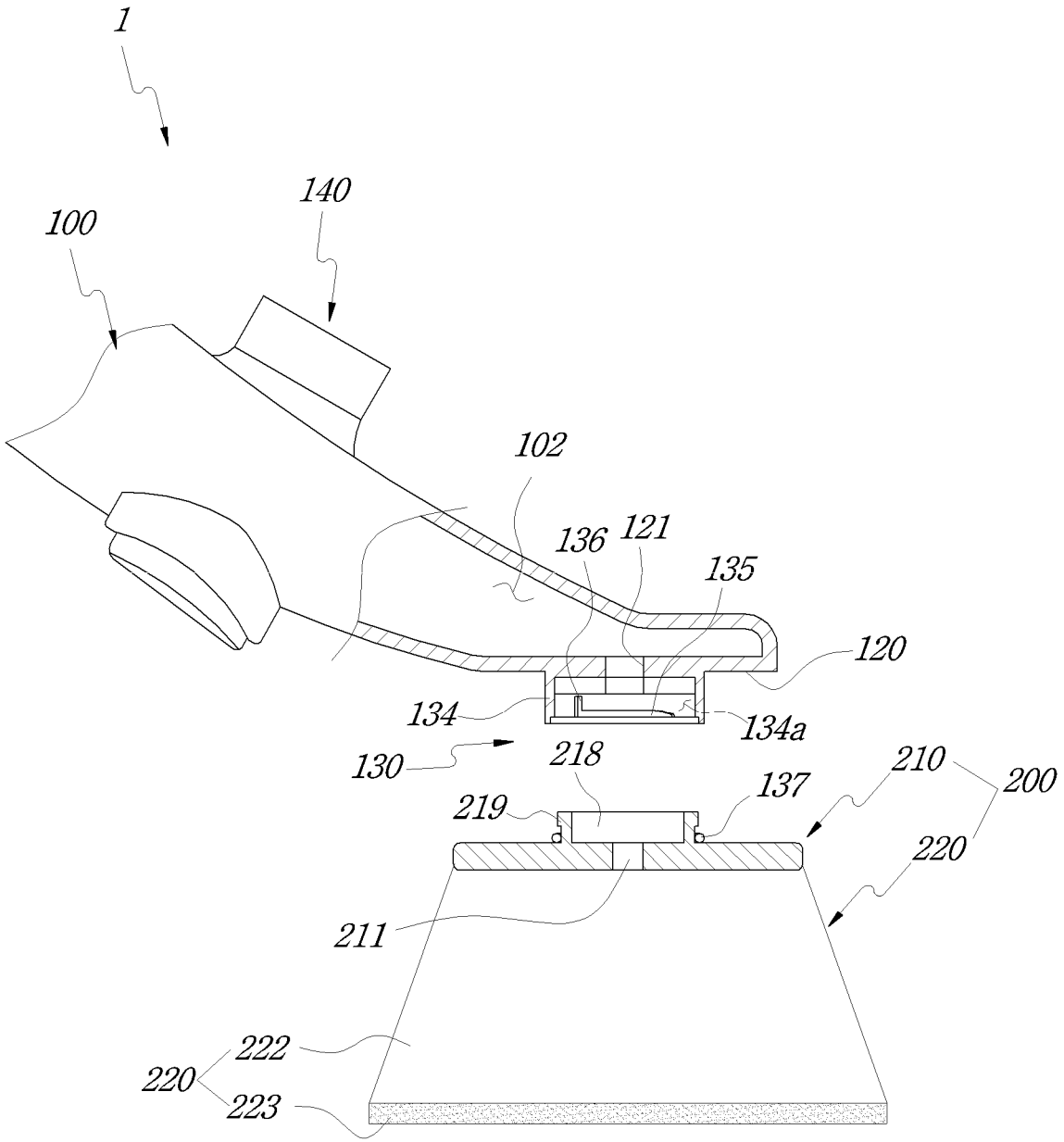
FIG. 9 is a sectional view showing the cleaning tool according to the third embodiment of the present invention.
Figure 10:
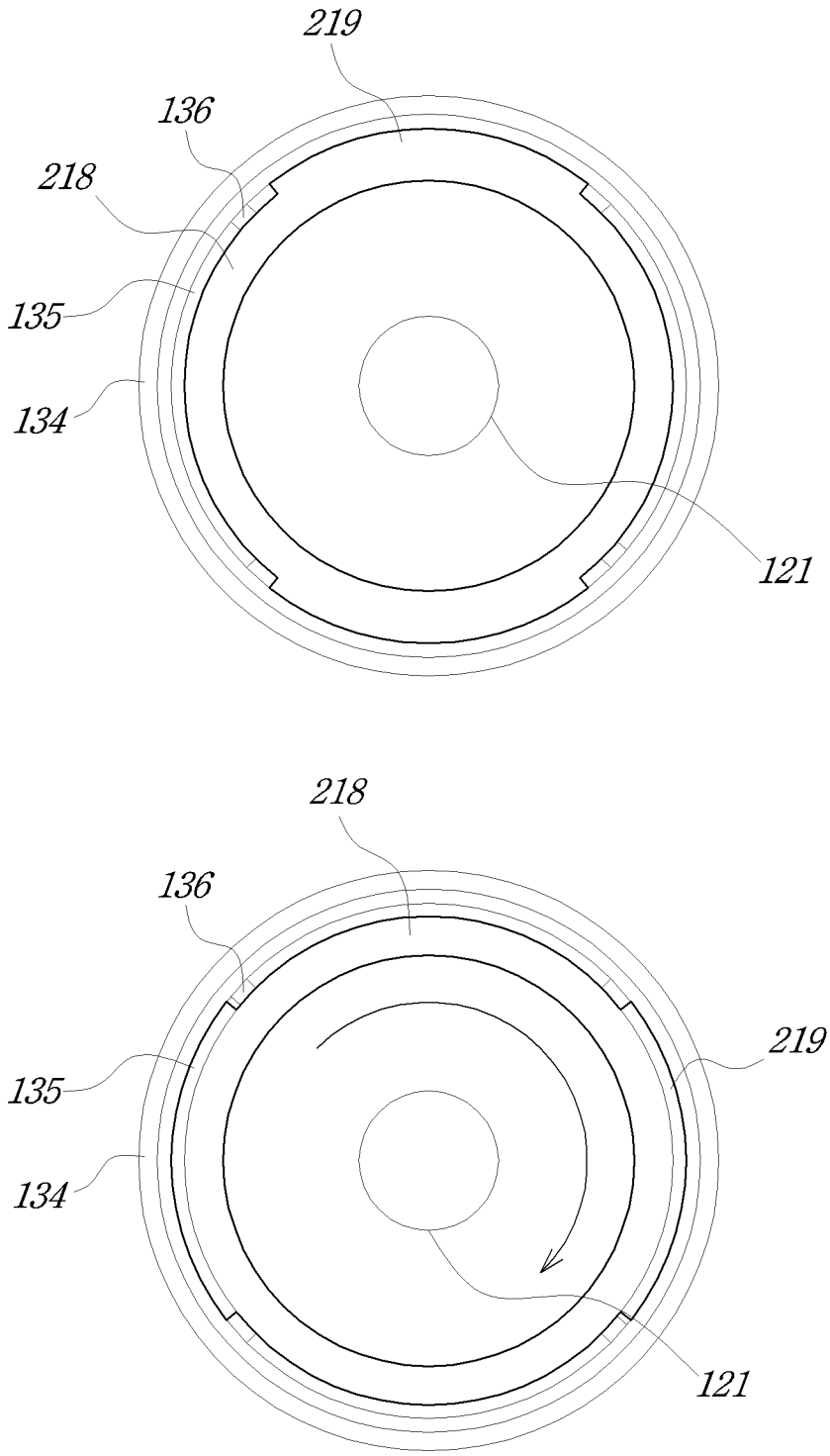
FIG. 10 is a top view showing a fastening structure of the cleaning tool according to the third embodiment of the present invention.

FIGS. 8 to 10 show a cleaning tool according to a third embodiment of the present invention. According to the third embodiment of the present invention, a cleaner support 130 disposed on the other end of a handle 100 includes a first cylindrical fastening protrusion 134 protruding downward from the underside of a finishing member 120 around a water discharge hole 121 formed on the finishing member 120, and the first fastening protrusion 134 has an insertion groove 134*a* open downward and a first support projection 135 and a stop projection 136 formed on the inner peripheral surface of the insertion groove 134*a*. In this case, the stop projection 136 protrudes upward from one end of the first support projection 135, and the first support projection 134 and the stop projection 136 are connected to each other to the shape of ∟.

Further, a cleaner 200 includes a second cylindrical fastening protrusion 218 protruding upward from the top of a support body 210 thereof around a water guide hole 211 formed on the support body 210 and fitted to the insertion groove 134*a* of the first fastening protrusion 134, and the second fastening protrusion 218 has a second support projection 219 supported against the first support projection 135 of the first fastening protrusion 134.

In this case, the first support projection 135 is partially horizontally formed on the inner peripheral surface of the insertion groove 134*a*, and the second support projection 219 is partially horizontally formed on the outer peripheral surface of the second fastening protrusion 218. As a result, in a state where the second fastening protrusion 218 is inserted into the insertion groove 134*a* of the first fastening protrusion 134 as shown in FIG. 10*a*, if the first fastening protrusion 134 horizontally rotates in one direction (clockwise direction) as shown in FIG. 10*b*, top end of the first support projection 135 of the first fastening protrusion 134 comes into close contact with the lower end of the second support projection 219 of the second fastening protrusion 218 and rotates by a given degree, so that the stop projection 136 comes into contact with one end of the second support projection 219 to cause no more rotation. In the coupled state, the cleaning tool 1 can be used.

Under the above-mentioned configuration, if the cleaner 200 rotates horizontally by an angle between 30 to 90° with respect to the handle 100, it may be easily coupled or separated to or from the handle 100. In this case, a leakage prevention ring 137 is fitted to the outer periphery of the second fastening protrusion 218, and when the second fastening protrusion 218 is fitted to the first fastening protrusion 134 and rotates in one direction to allow top end of the first support projection 135 of the first fastening protrusion 134 to come into close contact with the lower end of the second support projection 219 of the second fastening protrusion 218, accordingly, the leakage prevention ring 137 prevents generation of a gap between the lower end of the first fastening protrusion 134 and the top surface of the support body 210 of the cleaner 200 to avoid the tap water from leaking to the outside.

In this case, as shown in FIG. 9, a cleaning member 220 includes a sponge 222 disposed on the underside of the support body 210 and a towel 223 disposed on the underside of the sponge 222. In this case, the sponge 222 and the towel 223 are integral with each other by means of an adhesive, and next, they may be fixed to the underside of the support body 210 by means of an adhesive. The towel 223 is made of a viscose rayon material used typically to rub off the dead skin.

Figure 11A:
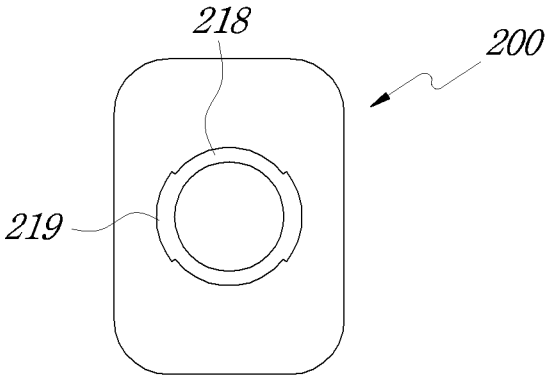
FIGS. 11A to 11C are top views showing various examples of a cleaner according to the present invention.
Figure 11B:
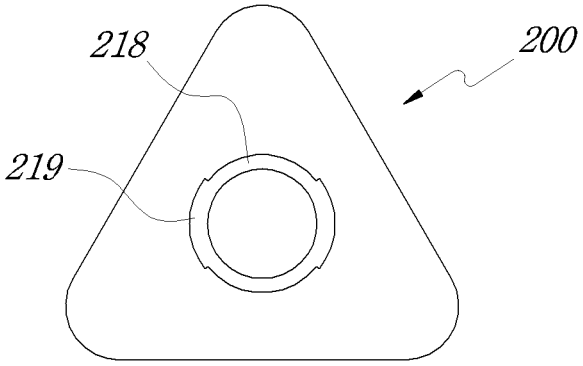
Figure 11C:
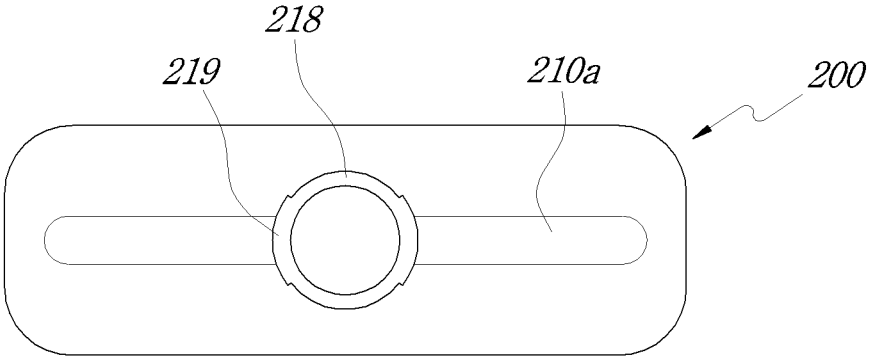

FIGS. 11A to 11C are top views showing various examples of the cleaner 200 according to the present invention. As shown in FIGS. 11A and 11C, the support body 210 of the cleaner 200 may have square and rectangular tops, and otherwise, as shown in FIG. 11B, it may have a triangular top. Of course, it may have a circular top if necessary.

Figure 12:
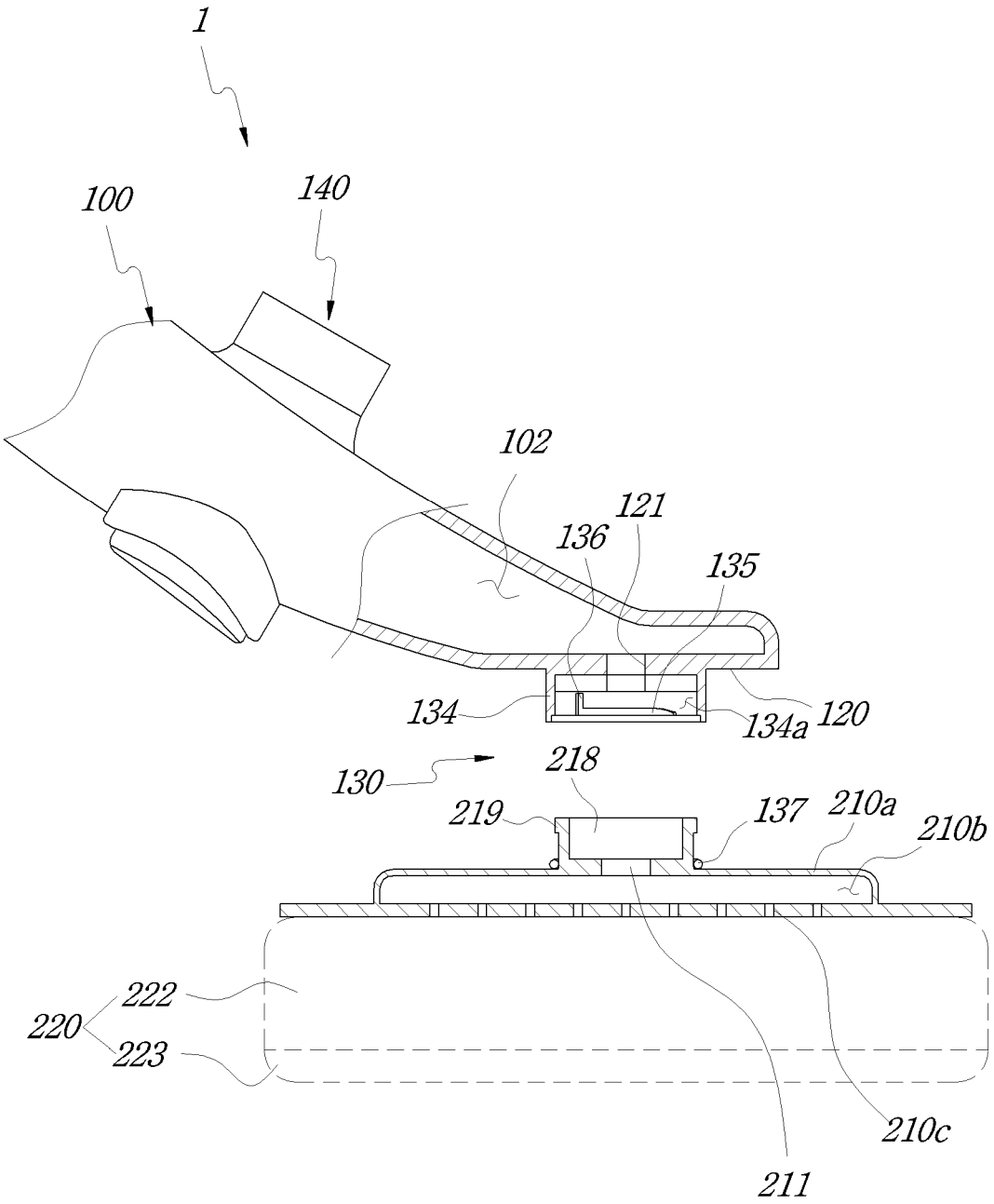
FIG. 12 is a sectional view showing a cleaning tool according to a fourth embodiment of the present invention.

FIG. 12 is a sectional view showing a cleaning tool according to a fourth embodiment of the present invention. According to the fourth embodiment of the present invention, a cleaner 200 includes a cover 210*a* disposed on top of a support body 210 to form a buffering space 210*b* therein, a water guide hole 211 formed on the cover 210*a*, and a plurality of water discharge holes 210*c* formed on the bottom of the buffering space 210*b*. Under the above-mentioned configuration, the tap water of the handle 100 is introduced into the buffering space 210*b* through the water guide hole 211 and equally discharged to the center and edge of the cleaning member 220 through the plurality of water discharge holes 210*c*.

Figure 13:
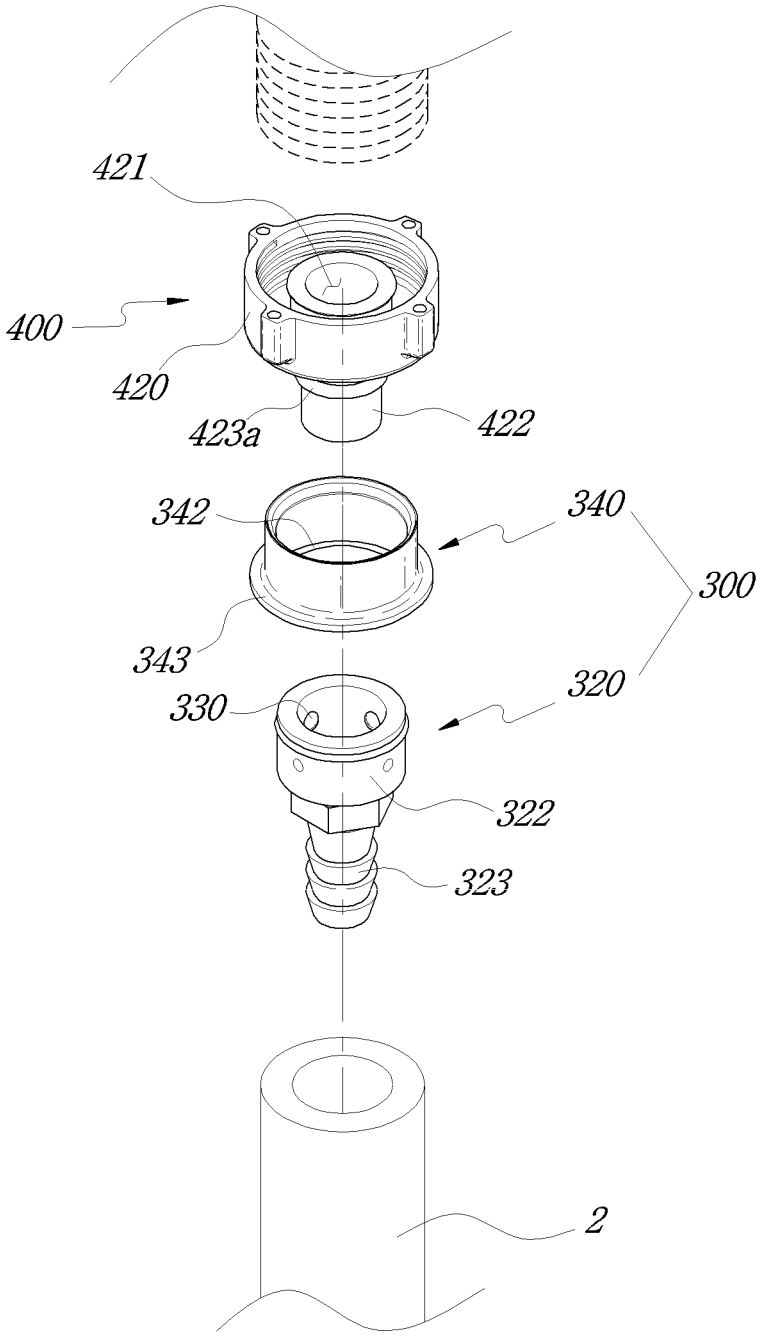
FIG. 13 is a perspective view showing a cleaning tool according to a fifth embodiment of the present invention.
Figure 14:
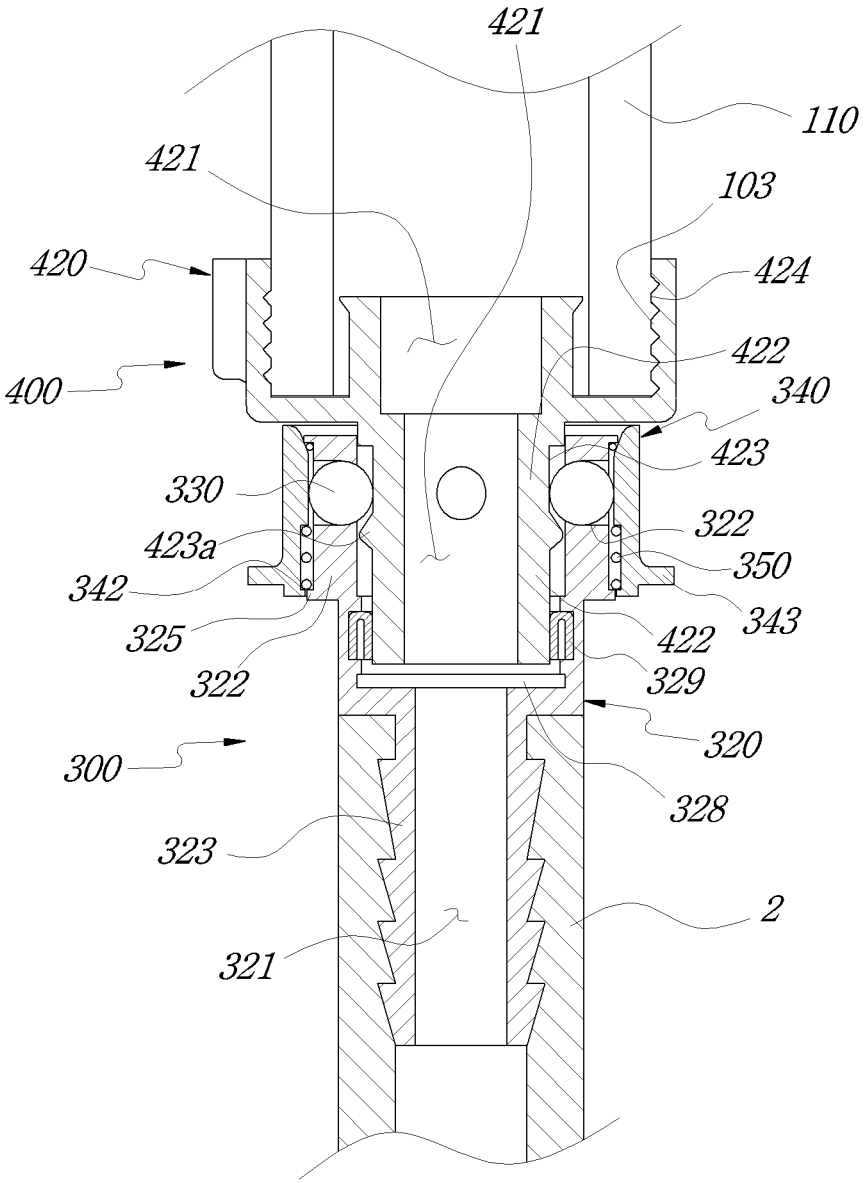
FIG. 14 is a sectional view showing the cleaning tool according to the fifth embodiment of the present invention.

FIGS. 13 and 14 show a cleaning tool according to a fifth embodiment of the present invention. The fifth embodiment of the present invention relates to a first connection means 300 disposed on the end of the shower hose 2 and a second connection means 400 disposed on one end of the handle 100 of the cleaning tool 1.

In this case, the first connection means 300 is mounted on the end of the shower hose 2 and includes a fixing member 320 having a first path 321 formed in a longitudinal direction thereof, one end portion fixed to the front end of the shower hose 2, and a plurality of ball seating portions 322 formed on the other end portion thereof, a plurality of fixing balls 330 rotatably disposed on the plurality of ball seating portions 322, and a push member 340 fastened to the outer peripheral surface of the fixing member 320 to support the fixing balls 330 and movable along the fixing member 320 to allow the fixing balls 330 to appear and disappear toward and from the first path 321.

In this case, the fixing member 320 has reverse locking projections 323 formed on the outer peripheral surface of one end portion thereof so that the fixing member 320 can be firmly fixed to the end of the shower hose 2. Further, the fixing member 320 has a support projection 325 formed on the outer peripheral surface of the other end portion thereof, and the push member 340 has a spring seating groove 342 formed on the inside thereof to mount a first spring 350 thereonto so that the push member 340 can be pressurized toward the other end portion of the fixing member 320, and a control protrusion 343 disposed on the outside thereof to be taken by the user's hand.

Further, the second connection means 400 is disposed on one end of the handle 100 and includes a connection part 422 disposed on one end portion thereof, having a second path 421 formed in a longitudinal direction thereof, and fitted to the first path 321 of the fixing member 320, and a connection member 420 disposed on the other end portion thereof and having a female screw thread 424 screw-coupled to the handle 100. In this case, the connection part 422 has ball support grooves 423 formed on the outer peripheral surface thereof to support the fixing balls 330 thereagainst on the same circumferences as the fixing balls 330. In this case, the ball support grooves 423 are concavely formed on the outer peripheral surface of the connection part 422, but they may be formed distinguishedly from a support protrusion 423*a* protruding outward from the same circumference as the connection part 422, so that if there is an interference caused by the push member 340, the fixing balls 330 pass over the support protrusion 423*a* and move to the ball support grooves 423.

The connection member 420 is fastened directly to one end of the handle 100, but the fastener 110 coupled to one end of the handle 100 may be changed in configuration to have a male screw thread formed on the outer peripheral surface thereof, so that the connection member 420 may be screw-coupled to the fastener 110. Such a change in design may be included in the scope of the present invention.

Further, water leakage prevention rings 328 and 329 are mounted on the first path 321 of the fixing member 320, and if one end portion of the connection part 422 is inserted into the first path 321, the end portion and outer peripheral surface of the connection part 422 come into close contact with the water leakage prevention rings 328 and 329 to prevent the tap water from leaking to the outside.

Under the above-mentioned configuration, if the handle 100 pulls toward one end portion of the fixing member 320 upon connection between the first connection means 300 and the second connection means 400, the physical force of the push member 340 applied to the fixing balls 330 is released, and in this state, if the handle 100 is removed from the user's hand after the connection part 422 of the connection member 420 has been inserted into the first path 321 of the fixing member 320, the push member 340 moves to one end portion of the fixing member 320 by means of the restoring force of the first spring 350 to allow the fixing balls 330 to be pushed toward the first path 321 of the fixing member 320, so that portions of the fixing balls 330 are kept supported against the ball support grooves 423 formed on the outer peripheral surface of the connection part 422 of the connection member 420 to prevent the separation between the first connection means 300 and the second connection means 400.

If it is desired to separate the first connection means 300 and the second connection means 400 from each other, of course, the handle 100 is pulled toward one end portion of the fixing member 320, and accordingly, the physical force of the push member 340 applied to the fixing balls 330 is released, so that the first connection means 300 and the second connection means 400 can be easily separated from each other.

Figure 15:
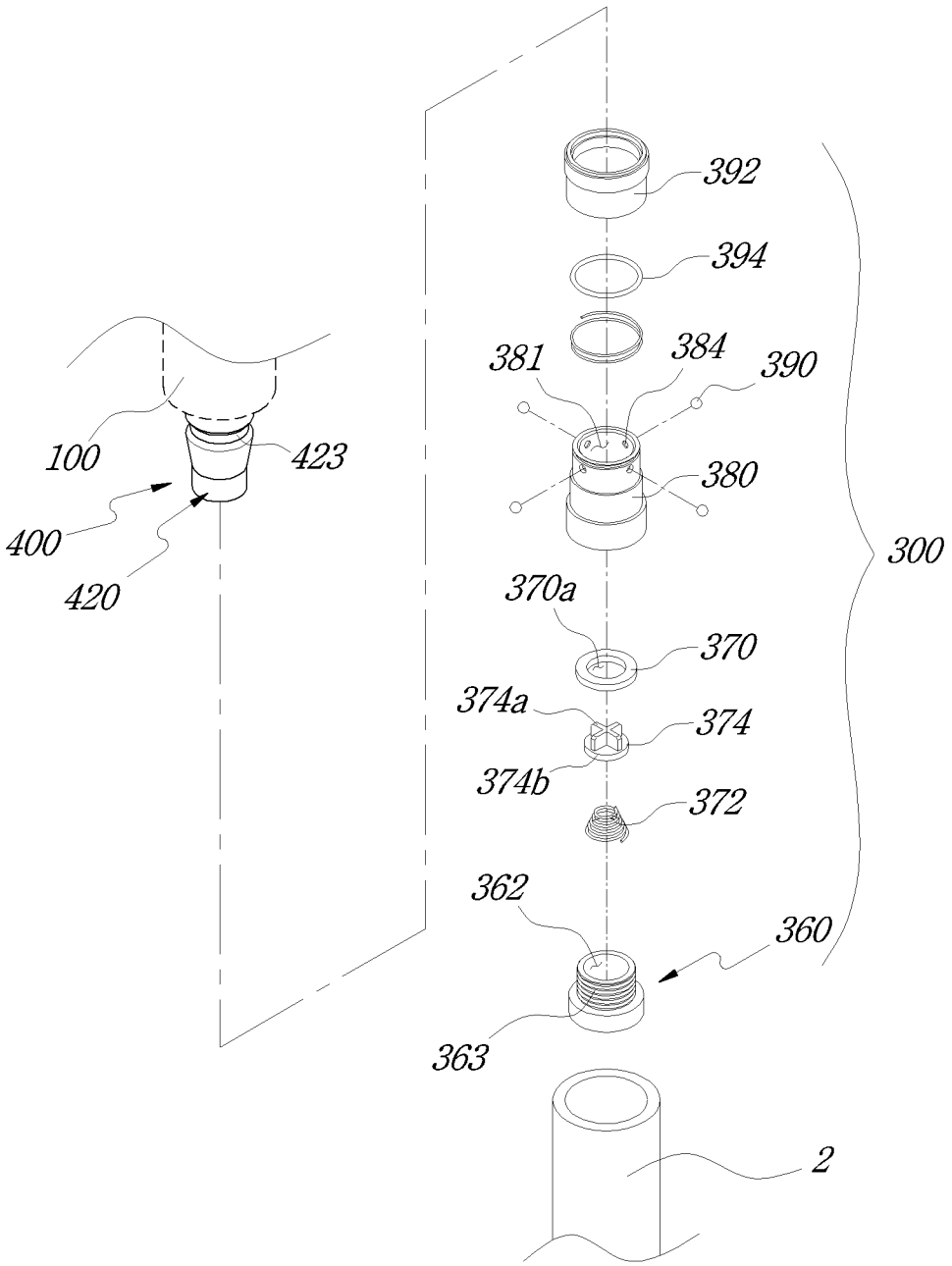
FIG. 15 is a perspective view showing a cleaning tool according to a sixth embodiment of the present invention.
Figure 16:
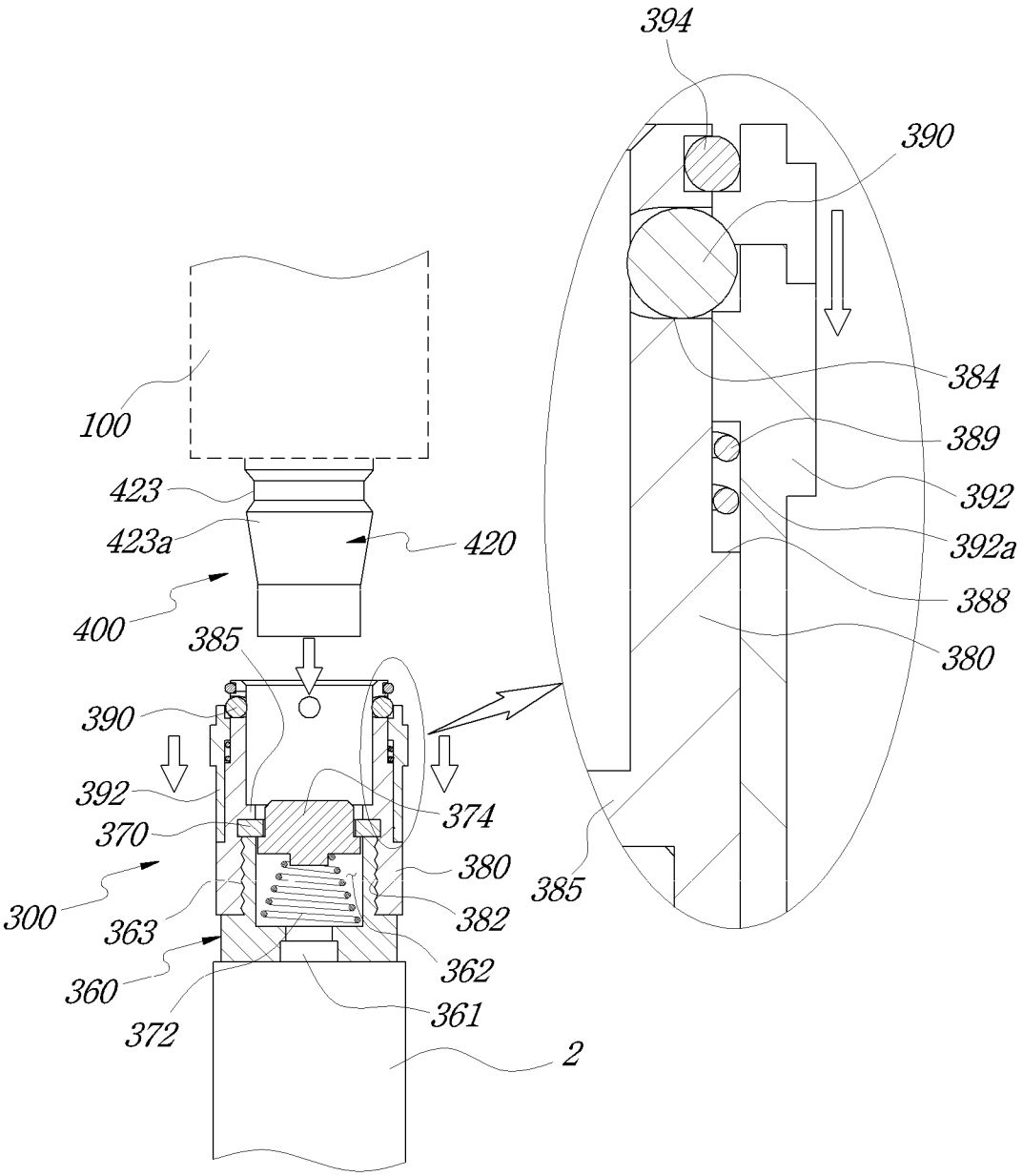
FIGS. 16 and 17 are sectional views showing states before and after the cleaning tool according to the sixth embodiment of the present invention is connected to an end of a shower hose.
Figure 17:
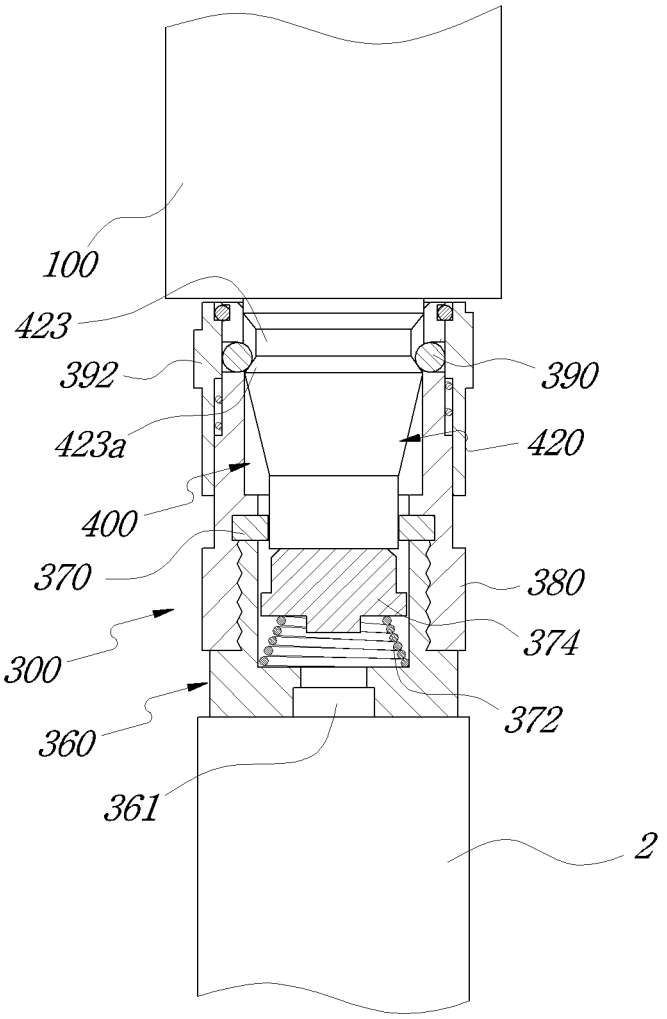

FIGS. 15 to 17 show a cleaning tool according to a sixth embodiment of the present invention. The sixth embodiment of the present invention is a variation of the fifth embodiment of the present invention.

In this case, a first connection means 300 is mounted on the end of a shower hose 2 of a faucet and includes a coupling member 360 fixed to the front end of the shower hose 2, having a through hole 361 formed on the center thereof, a seating portion 362 formed open on the other end thereof, and a male screw thread 363 formed on the outer peripheral surface thereof, a support ring 370 supported against the other end of the coupling member 360 and having an opening and closing through hole 370*a* formed on the center thereof, an opening and closing member 374 elastically supported against the seating portion 362 of the coupling member 360 by means of a second spring 372 to open and close the opening and closing through hole 370*a*, a fixing member 380 having a first path 381 formed in a longitudinal direction thereof, a female screw thread 382 formed on one end portion thereof and screw-coupled to the coupling member 360, a pressurizing protrusion 385 protruding from the center of the first path 382 to pressurize the support ring 370 toward the other end portion of the coupling member 360, and a plurality of ball seating portions 384 formed on the other end portion thereof, a plurality of fixing balls 390 rotatably disposed on the plurality of ball seating portions 384, and a push member 392 fastened to the outer peripheral surface of the fixing member 380 to support the fixing balls 390 and movable along the fixing member 380 to allow the fixing balls 390 to appear and disappear toward and from the first path 381.

In this case, the coupling member 360 is insertedly fixed to the end of the shower hose 2, but it is possible that the end of the shower hose 2 is inserted into the coupling member 360. Such a change in design may be included in the scope of the present invention.

The opening and closing member 374 has a cross type protrusion 374*a* formed on the other end thereof to move the tap water gently and an escape prevention projection 374*b* formed on the outer peripheral surface thereof to prevent the escape from the seating portion 362 of the coupling member 360 even if an elastic force of the second spring 372 is applied thereto.

Further, the fixing member 380 has a support projection 388 formed on the outer peripheral surface of the other end portion thereof, and the push member 392 has a spring seating groove 392*a* formed on the inside thereof to mount a first spring 389 thereon so that the push member 392 is pressurized against the other end portion of the fixing member 380.

Further, the second connection means 400 is disposed on one end of the handle 100 and has the same configuration as in the fifth embodiment of the present invention. That is, the second connection means 400 includes a connection part 422 disposed on one end portion thereof, having a second path 421 formed in a longitudinal direction thereof, and fitted to the first path 321 of the fixing member 320, and a connection member 420 disposed on the other end portion thereof and having a female screw thread 424 screw-coupled to the handle 100. In this case, the connection part 422 has a ball support groove 423 formed on the outer peripheral surface thereof to support the fixing balls 330 thereagainst on the same circumference as the fixing balls 330.

In this case, when the connection part 422 is inserted into the first path 381 of the fixing member 380, the end portion of the connection part 422 pressurizes the opening and closing member 374 to open the opening and closing through hole 370*a* of the support ring 370.

Further, a water leakage prevention ring 394 is mounted on the top outer peripheral surface of the fixing member 380.

Under the above-mentioned configuration, if the push member 392 pulls toward one end portion of the fixing member 380 upon connection between the first connection means 300 and the second connection means 400, the physical force of the push member 392 applied to the fixing balls 390 is released, and in this state, if the handle 100 is removed from the user's hand after the connection part 422 of the connection member 420 has been inserted into the first path 381 of the fixing member 380, the push member 392 moves to one end portion of the fixing member 380 by means of the restoring force of the first spring 389 to allow the fixing balls 390 to be pushed toward the first path 381 of the fixing member 380, so that portions of the fixing balls 390 are kept supported against the ball support grooves 423 formed on the outer peripheral surface of the connection part 422 of the connection member 420 to prevent the separation between the first connection means 300 and the second connection means 400.

If it is desired to separate the first connection means 300 and the second connection means 400 from each other, of course, the push member 392 is pulled toward one end portion of the fixing member 80, and accordingly, the physical force of the push member 392 applied to the fixing balls 390 is released, so that the first connection means 300 and the second connection means 400 can be easily separated from each other.

Under the above-mentioned configuration, even though the lever of the faucet is open, the supply of the tap water is blocked in a state where the shower head or the cleaning tool 1 of the present invention is connected to the faucet, the shower head and the cleaning tool 1 can be stably exchanged with each other.

Figure 18:
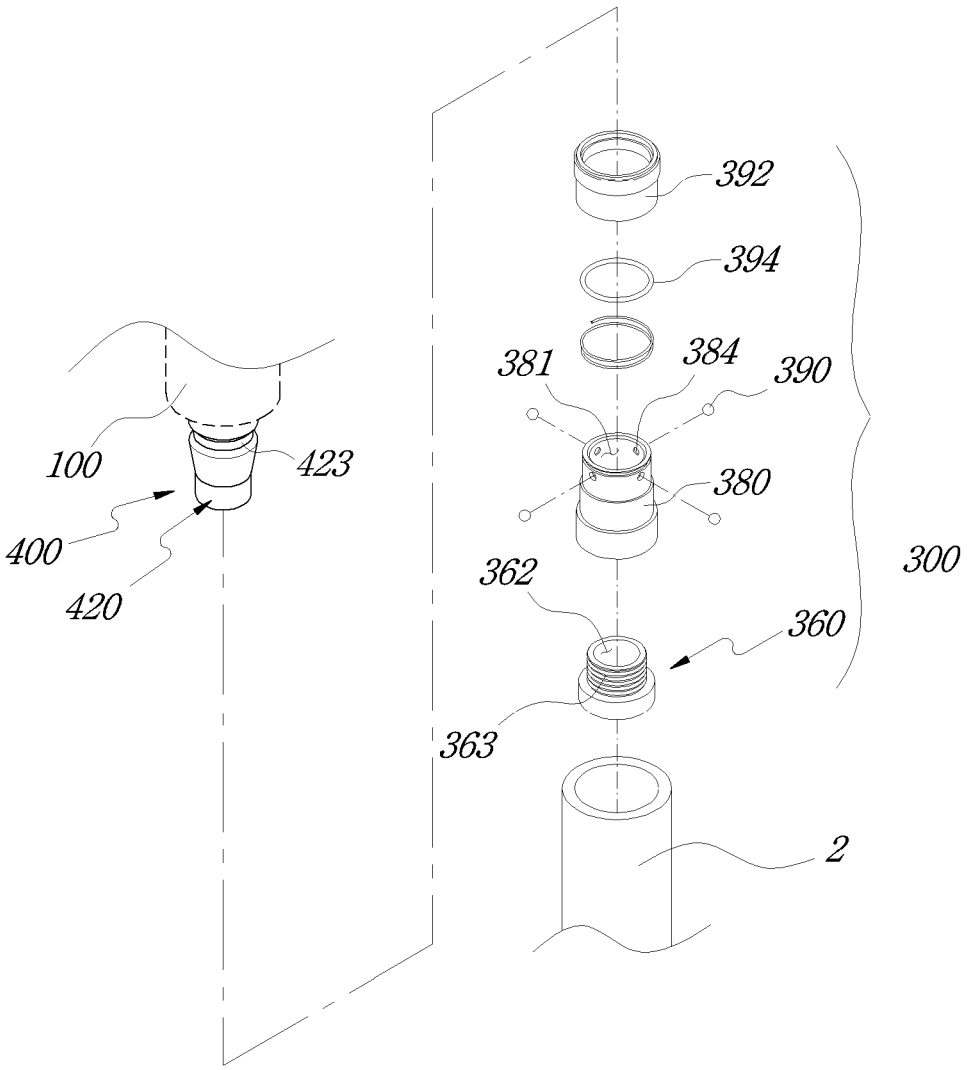
FIG. 18 is a perspective view showing a cleaning tool according to a seventh embodiment of the present invention.
Figure 19:
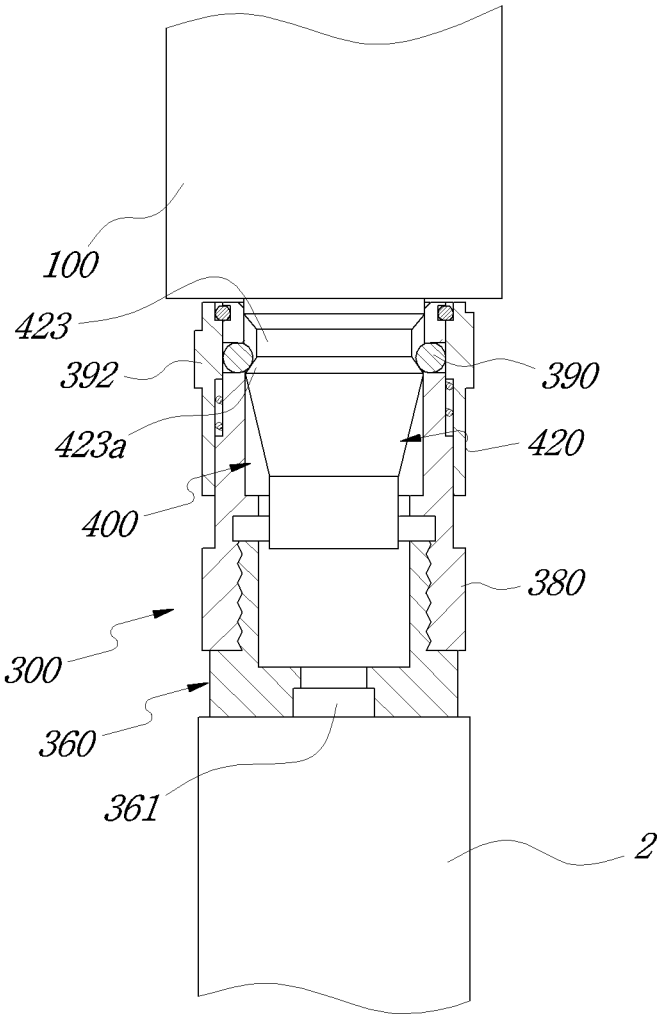
FIG. 19 is a sectional view showing a state before the cleaning tool according to the seventh embodiment of the present invention is connected to an end of a shower hose.

FIGS. 18 and 19 show a cleaning tool according to a seventh embodiment of the present invention. The seventh embodiment of the present invention is a variation of the sixth embodiment of the present invention.

In this case, a first connection means 300 has the same configuration as the first connection means 300 adopted in the sixth embodiment of the present invention, while having no support ring 370, second spring 372, and opening and closing member 374 adopted in the sixth embodiment of the present invention.

In specific, the first connection means 300 includes a coupling member 360 fixed to the front end of the shower hose 2, having a through hole 361 formed on the center thereof, a seating portion 362 formed open on the other end thereof, and a male screw thread 363 formed on the outer peripheral surface thereof, a fixing member 380 having a first path 381 formed in a longitudinal direction thereof, a female screw thread 382 formed on one end portion thereof and screw-coupled to the coupling member 360, and a plurality of ball seating portions 384 formed on the other end portion thereof, a plurality of fixing balls 390 rotatably disposed on the plurality of ball seating portions 384, and a push member 392 fastened to the outer peripheral surface of the fixing member 380 to support the fixing balls 390 and movable along the fixing member 380 to allow the fixing balls 390 to appear and disappear toward and from the first path 381.

Under the above-mentioned configuration, tap water can be supplied from the shower hose 2 of the faucet even before the first connection means 300 and the second connection means 400 are connected to each other. In a state where the lever of the faucet is not open, accordingly, the supply of the tap water is blocked so that the shower head and the cleaning tool 1 can be stably exchanged with each other. In a state where the lever of the faucet is open, desirably, the shower head or the cleaning tool 1 of the present invention is not connected to the faucet.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A cleaning tool comprising:

a handle having a first connection means disposed on one end of a shower hose, a second connection means detachably coupled to the first connection means, and a main flow path along which tap water flows from one end thereto to another end thereof; and a cleaner detachably coupled to an end of the handle to clean a surface to be cleaned with the tap water supplied from the handle, wherein the handle comprises: a finishing member disposed on the end thereof and having a water discharge hole formed thereon; and a cleaner support disposed on the finishing member to allow the cleaner to be detachably mounted thereon and having a front support protrusion protruding forward from a front end of the finishing member disposed on the end of the handle and a rear support protrusion protruding backward from a rear end of the finishing member, wherein the cleaner comprises: a support body detachably supported against the cleaner support; and a cleaning member disposed on an underside of the support body, the support body comprising a water guide hole formed thereon to guide the tap water moving through the water discharge hole of the finishing member disposed on the end of the handle to the cleaning member, a front support groove formed on a front end of top surface thereof to supportedly fit the front support protrusion of the cleaner support thereto, a rear support groove formed on a rear end of the top surface thereof to supportedly fit the rear support protrusion of the cleaner support thereto, a locking projection with a guide inclination surface protruding from a top of the rear support groove to support the rear support protrusion of the cleaner support (130), and a releasing piece extending backward from the locking projection, and wherein the cleaner comprises a cover disposed on a top of the support body to form a buffering space therein, the water guide hole formed on the cover, and a plurality of water discharge holes formed on a bottom of the buffering space.

2. The cleaning tool according to claim 1, wherein the first connection means comprises a fixing member having a first path formed in a longitudinal direction thereof, one end portion fixed to a front end of the shower hose, and a plurality of ball seating portions formed on another end portion thereof, a plurality of fixing balls rotatably disposed on the plurality of ball seating portions, and a push member fastened to an outer peripheral surface of the fixing member to support the fixing balls and movable along the fixing member to allow the fixing balls to appear and disappear toward and from the first path, the fixing member comprising a support projection formed on the outer peripheral surface of the another end portion thereof, and the push member comprising a spring seating groove formed inside thereof to mount a first spring thereonto so that the push member can be pressurized toward the another end portion of the fixing member and a control protrusion disposed outside thereof to be taken by a user's hand, and the second connection means comprises a connection part disposed on one end portion thereof and having a second path formed in a longitudinal direction thereof and fitted to the first path of the fixing member, and a connection member disposed on another end portion thereof and having a female screw thread screw-coupled to the handle, the connection part comprising ball support grooves formed on an outer peripheral surface thereof to support the fixing balls thereagainst on same circumferences as the fixing balls.

3. The cleaning tool according to claim 1, wherein the first connection means comprises a coupling member fixed to a front end of the shower hose, having a through hole formed on a center thereof, a seating portion formed open on an end thereof, and a male screw thread formed on an outer peripheral surface thereof, a support ring supported against the end of the coupling member and having an opening and closing through hole formed on a center thereof, an opening and closing member elastically supported against the seating portion of the coupling member by means of a second spring to open and close the opening and closing through hole, a fixing member having a first path formed in a longitudinal direction thereof, a female screw thread formed on one end portion thereof and screw-coupled to the coupling member, a pressurizing protrusion protruding from a center of the first path to pressurize the support ring toward the end portion of the coupling member, and a plurality of ball seating portions formed on the end portion thereof, a plurality of fixing balls rotatably disposed on the plurality of ball seating portions, and a push member fastened to an outer peripheral surface of the fixing member to support the fixing balls and movable along the fixing member to allow the fixing balls to appear and disappear toward and from the first path, the fixing member comprising a support projection formed on an outer peripheral surface of another end portion thereof, and the push member comprising a spring seating groove formed inside thereof to mount a first spring thereon so that the push member is pressurized against the another end portion of the fixing member, and the second connection means comprises a connection part disposed on one end portion thereof, having a second path formed in a longitudinal direction thereof, and fitted to the first path of the fixing member, and a connection member disposed on another end portion thereof and having a female screw thread screw-coupled to the handle, the connection part comprising ball support grooves formed on an outer peripheral surface thereof to support the fixing balls thereagainst on same circumferences as the fixing balls so that when the connection part is inserted into the first path of the fixing member, the one end portion of the connection part pressurizes the opening and closing member to open the opening and closing through hole of the support ring.

4. The cleaning tool according to claim 1, wherein the first connection means comprises a coupling member fixed to a front end of the shower hose, having a through hole formed on a center thereof, a seating portion formed open on an end thereof, and a male screw thread formed on an outer peripheral surface thereof, a fixing member having a first path formed in a longitudinal direction thereof, a female screw thread formed on one end portion thereof and screw-coupled to the coupling member, and a plurality of ball seating portions formed on another end portion thereof, a plurality of fixing balls rotatably disposed on the plurality of ball seating portions, and a push member fastened to an outer peripheral surface of the fixing member to support the fixing balls and movable along the fixing member to allow the fixing balls to appear and disappear toward and from the first path, the fixing member comprising a support projection formed on an outer peripheral surface of the another end portion thereof, and the push member comprising a spring seating groove formed inside thereof to mount a first spring thereon so that the push member is pressurized against the another end portion of the fixing member, and the second connection means comprises a connection part disposed on one end portion thereof, having a second path formed in a longitudinal direction thereof, and fitted to the first path of the fixing member, and a connection member disposed on another end portion thereof and having a female screw thread screw-coupled to the handle, the connection part comprising ball support grooves formed on an outer peripheral surface thereof to support the fixing balls thereagainst on same circumferences as the fixing balls.

5. The cleaning tool according to claim 1, wherein the handle comprises a tap water controller adapted to open and close the main flow path along which the tap water moves, and the tap water controller comprises a slide member fitted to guide members disposed up and down on the handle to be movable up and down and having a guide hole formed in a forward and backward direction thereof, button members coupled to upper and lower ends of the slide member and pressurized by the user's hand, and a pressurizing member fitted to a seating portion formed on the main flow path and having a flow path formed in a forward and backward direction thereof to move the tap water therealong so that another end thereof comes into close contact with one end of the slide member by means of the elasticity of a spring disposed in the flow path.

6. A cleaning tool comprising:

a handle having a first connection means disposed on one end of a shower hose, a second connection means detachably coupled to the first connection means, and a main flow path along which tap water flows from one end thereto to another end thereof; and a cleaner detachably coupled to an end of the handle to clean a surface to be cleaned with the tap water supplied from the handle, wherein the handle comprises: a finishing member disposed on the end thereof and having a water discharge hole formed thereon; and a cleaner support disposed on the finishing member to allow the cleaner to be detachably mounted thereon and having a front support protrusion protruding forward from a front end of the finishing member disposed on the end of the handle and a rear support protrusion protruding backward from a rear end of the finishing member, wherein the cleaner comprises: a support body detachably supported against the cleaner support; and a cleaning member disposed on an underside of the support body, the support body comprising a water guide hole formed thereon to guide the tap water moving through the water discharge hole of the finishing member disposed on the end of the handle to the cleaning member, a front support groove formed on a front end of top surface thereof to supportedly fit the front support protrusion of the cleaner support thereto, a rear support groove formed on a rear end of the top surface thereof to supportedly fit the rear support protrusion of the cleaner support thereto, a locking projection with a guide inclination surface protruding from a top of the front support groove to support the front support protrusion of the cleaner support, and a releasing piece extending forward from the locking projection, and wherein the cleaner comprises a cover disposed on a top of the support body to form a buffering space therein, a water guide hole formed on the cover, and a plurality of water discharge holes formed on a bottom of the buffering space.

7. The cleaning tool according to claim 6, wherein the first connection means comprises a fixing member having a first path formed in a longitudinal direction thereof, one end portion fixed to a front end of the shower hose, and a plurality of ball seating portions formed on another end portion thereof, a plurality of fixing balls rotatably disposed on the plurality of ball seating portions, and a push member fastened to an outer peripheral surface of the fixing member to support the fixing balls and movable along the fixing member to allow the fixing balls to appear and disappear toward and from the first path, the fixing member comprising a support projection formed on the outer peripheral surface of the another end portion thereof, and the push member comprising a spring seating groove formed inside thereof to mount a first spring thereonto so that the push member can be pressurized toward the another end portion of the fixing member and a control protrusion disposed outside thereof to be taken by a user's hand, and the second connection means comprises a connection part disposed on one end portion thereof and having a second path formed in a longitudinal direction thereof and fitted to the first path of the fixing member, and a connection member disposed on another end portion thereof and having a female screw thread screw-coupled to the handle, the connection part comprising ball support grooves formed on an outer peripheral surface thereof to support the fixing balls thereagainst on same circumferences as the fixing balls.

8. The cleaning tool according to claim 6, wherein the first connection means comprises a coupling member fixed to a front end of the shower hose, having a through hole formed on a center thereof, a seating portion formed open on an end thereof, and a male screw thread formed on an outer peripheral surface thereof, a support ring supported against the end of the coupling member and having an opening and closing through hole formed on a center thereof, an opening and closing member elastically supported against the seating portion of the coupling member by means of a second spring to open and close the opening and closing through hole, a fixing member having a first path formed in a longitudinal direction thereof, a female screw thread formed on one end portion thereof and screw-coupled to the coupling member, a pressurizing protrusion protruding from a center of the first path to pressurize the support ring toward the end portion of the coupling member, and a plurality of ball seating portions formed on the end portion thereof, a plurality of fixing balls rotatably disposed on the plurality of ball seating portions, and a push member fastened to an outer peripheral surface of the fixing member to support the fixing balls and movable along the fixing member to allow the fixing balls to appear and disappear toward and from the first path, the fixing member comprising a support projection formed on an outer peripheral surface of another end portion thereof, and the push member comprising a spring seating groove formed inside thereof to mount a first spring thereon so that the push member is pressurized against the another end portion of the fixing member, and the second connection means comprises a connection part disposed on one end portion thereof, having a second path formed in a longitudinal direction thereof, and fitted to the first path of the fixing member, and a connection member disposed on another end portion thereof and having a female screw thread screw-coupled to the handle, the connection part comprising ball support grooves formed on an outer peripheral surface thereof to support the fixing balls thereagainst on same circumferences as the fixing balls so that when the connection part is inserted into the first path of the fixing member, the one end portion of the connection part pressurizes the opening and closing member to open the opening and closing through hole of the support ring.

9. The cleaning tool according to claim 6, wherein the first connection means comprises a coupling member fixed to a front end of the shower hose, having a through hole formed on a center thereof, a seating portion formed open on an end thereof, and a male screw thread formed on an outer peripheral surface thereof, a fixing member having a first path formed in a longitudinal direction thereof, a female screw thread formed on one end portion thereof and screw-coupled to the coupling member, and a plurality of ball seating portions formed on another end portion thereof, a plurality of fixing balls rotatably disposed on the plurality of ball seating portions, and a push member fastened to an outer peripheral surface of the fixing member to support the fixing balls and movable along the fixing member to allow the fixing balls to appear and disappear toward and from the first path, the fixing member comprising a support projection formed on an outer peripheral surface of the another end portion thereof, and the push member comprising a spring seating groove formed inside thereof to mount a first spring thereon so that the push member is pressurized against the another end portion of the fixing member, and the second connection means comprises a connection part disposed on one end portion thereof, having a second path formed in a longitudinal direction thereof, and fitted to the first path of the fixing member, and a connection member disposed on another end portion thereof and having a female screw thread screw-coupled to the handle, the connection part comprising ball support grooves formed on an outer peripheral surface thereof to support the fixing balls thereagainst on same circumferences as the fixing balls.

10. The cleaning tool according to claim 6, wherein the handle comprises a tap water controller adapted to open and close the main flow path along which the tap water moves, and the tap water controller comprises a slide member fitted to guide members disposed up and down on the handle to be movable up and down and having a guide hole formed in a forward and backward direction thereof, button members coupled to upper and lower ends of the slide member and pressurized by the user's hand, and a pressurizing member fitted to a seating portion formed on the main flow path and having a flow path formed in a forward and backward direction thereof to move the tap water there along so that the other end thereof comes into close contact with one end of the slide member by means of the elasticity of a spring disposed in the flow path.

* * * * *